US005718611A

United States Patent [19]

Schlangen et al.

[11] Patent Number: 5,718,611

[45] Date of Patent: Feb. 17, 1998

[54] PERSONALIZED WATERCRAFT

[75] Inventors: Phillip E. Schlangen; Raymond J. Buresch, both of Minneapolis, Minn.

[73] Assignee: Hydro-Bikes, Inc., Minneapolis, Minn.

[21] Appl. No.: 316,031

[22] Filed: Sep. 30, 1994

Related U.S. Application Data

[63] Continuation-in-part of Ser. No. 38,922, Mar. 29, 1993, Pat. No. 5,405,275, Ser. No. 2,367, Dec. 10, 1992, Pat. No. Des. 353,572, Ser. No. 13,955, Oct. 7, 1993, Pat. No. Des. 356,064, and Ser. No. 25,684, Jun. 21, 1994.

[51] Int. Cl.[6] ..... B63H 16/20

[52] U.S. Cl. ..... 440/27; 440/30

[58] Field of Search ..... 440/26–30; 114/61, 114/352–354, 345, 85; 74/594.2; 474/144; 416/223 R, 238, 244 B

[56] References Cited

U.S. PATENT DOCUMENTS

| | | | |
|---|---|---|---|
| D. 163,169 | 5/1951 | Daugherty | D90/1 |
| D. 251,186 | 2/1979 | Patterson et al. | D12/11 |
| D. 287,847 | 1/1987 | Bobinac | D12/317 |
| D. 305,751 | 1/1990 | Roberson | D12/304 |
| D. 312,610 | 12/1990 | Price, Jr. | D12/304 |
| D. 321,854 | 11/1991 | Foley et al. | D12/306 |
| 637,547 | 11/1899 | Clark | 440/31 |
| 794,932 | 7/1905 | Fullerton | 440/49 |
| 1,019,437 | 3/1912 | Draper | 416/223 R |
| 1,695,304 | 12/1928 | Turner | 440/30 |
| 1,761,883 | 6/1930 | Froedtert | 440/30 |
| 2,039,392 | 5/1936 | Carroll | 440/30 |
| 2,177,074 | 10/1939 | Mattson | 440/31 |
| 2,240,998 | 5/1941 | Montiglio | 474/144 |
| 2,287,706 | 6/1942 | Perry | 440/30 |
| 2,631,559 | 3/1953 | Jones | 114/165 |
| 2,775,950 | 1/1957 | Dearmond | 440/30 |
| 2,984,845 | 5/1961 | Gregoire | 114/61 |
| 3,132,698 | 5/1964 | Lesher | 403/259 |
| 3,352,276 | 11/1967 | Zimmerman | 440/31 |
| 3,593,684 | 7/1971 | Cogliano | 114/61 |
| 4,021,873 | 5/1977 | Francois | 114/352 |
| 4,170,188 | 10/1979 | Jamison, Jr. | 440/30 |
| 4,323,352 | 4/1982 | Warren et al. | 440/27 |
| 4,493,657 | 1/1985 | Zeitler | 440/30 |
| 4,528,925 | 7/1985 | Pyburn | 114/61 |
| 4,533,330 | 8/1985 | Chun | 440/30 |
| 4,836,298 | 6/1989 | Laboureau | 114/61 |
| 4,968,274 | 11/1990 | Gregory | 440/27 |
| 5,011,441 | 4/1991 | Foley et al. | 440/30 |
| 5,224,886 | 7/1993 | Cunningham | 440/12 |
| 5,316,508 | 5/1994 | Landucci | 440/30 |
| 5,405,275 | 4/1995 | Schlangen et al. | 440/30 |

OTHER PUBLICATIONS

The Science and Technology of Low Speed and Motorless Flight, "Design of Propellers for Motorsoarers" article by E. Larrabee, 1979.

Scientific American, "Human-Powered Watercraft" brochure Dec., 1986.

*Primary Examiner*—Edwin L. Swinehart

[57] ABSTRACT

A watercraft has floats supporting a bicycle-type frame having handlebars connected to a rudder to steer the watercraft. Side boards located on opposite sides of the frame are mounted on cross bars which support the frame on the floats. A chain and sprocket foot operated drive is connected to a shaft journaled to a housing accommodating a power transmission for rotating a propeller. A chain guard is located on opposite sides of the chain connecting the shaft and foot operated drive. The housing is movable between a down location wherein the chain is retained in a tension condition to an up location wherein the chain is in a loose condition.

38 Claims, 16 Drawing Sheets

27
27
26
26
25
25
163
162
166
167
164
168
128
168A
164A
167A
108
166A
163A
162A
161
159
152
157

163A
162
166A
161
167A
168A
164A
128
152
158
168
164
108
167
162
166
159
163

PERSONALIZED WATERCRAFT

CROSS REFERENCE TO RELATED APPLICATION

This application is a continuation-in-part of U.S. application Ser. No. 08/038,922 filed Mar. 29, 1993, now U.S. Pat. No. 5,405,275; U.S. application Ser. No. 29/002,367 filed Dec. 10, 1992, now U.S. Pat. No. Des. 353,572; U.S. application Ser. No. 29/013,955 filed Oct. 7, 1993, now U.S. Pat. No. Des. 356,064; and U.S. application Ser. No. 29/025,684 filed Jun. 21, 1994.

FIELD OF THE INVENTION

The invention relates to human powered recreational watercraft that is propeller driven.

BACKGROUND OF INVENTION

Marine velocipedes having a pair of elongated floats supporting a propelling mechanism analogous to that employed by an ordinary bicycle construction for driving a propeller to move the velocipede on the body of water is shown by C. Clark in U.S. Pat. No. 637,547. The velocipede has a pedal operated drive train which rotates the propeller through shafts connected with a universal joint. K. R. Foredtret in U.S. Pat. No. 1,761,883 discloses a water vehicle having a pair of elongated pontoons supporting a bicycle-type frame. A pedal drive operates to rotate a propeller to move the vehicle on a body of water. Handlebars rotatably mounted on the frame are used to move a forwardly located rudder to steer the vehicle. Additional developments in human powered vehicles are shown by G. W. Mattson in U.S. Pat. No. 2,177,074 and J. J. Zimmermann in U.S. Pat. No. 3,352,276.

SUMMARY OF THE INVENTION

The invention is directed to a human powered watercraft having floatation units supporting a steering and propulsion assembly that includes a frame mounted on members attached to the floatation units. The frame movably supports handlebars attached to a rudder for steering the watercraft. Platforms mounted on the members provide foot supports for the operator of the watercraft. A power transmission assembly mounted on the frame is operated with a foot operated drive to rotate a propeller operable to move the watercraft on the water.

The preferred embodiment of the watercraft has a pair of elongated floatation units having downwardly tapered convex side walls that converge to a longitudinal keel. Top walls joined to the side walls enclose the interior chambers of the floatation units. Each top wall has a plurality of transverse recesses for accommodating cross bars that are releasably attached to the floatation units. The frame supporting a seat and handlebars is releasably mounted on the cross bars. The cross bars, frame and floatation units can be separated from each other to allow the watercraft to be conveniently transported in a knock-down condition. The propeller power transmission has a housing that is pivotally mounted on the frame and is normally extended in a downward position between the floatation units. The housing supports first, second and third shafts. Sprockets mounted on the first and second shafts accommodate an endless link chain to transmit power from the first shaft to the second shaft. A gear assembly driveably connects the second shaft to the third shaft which supports a propeller. A foot operated drive mounted on the frame is operably connected to the first shaft for rotating the propeller so as to move the watercraft on the body of water. The frame accommodates a seat so that the operator of the watercraft can pedal the foot operated drive in a seated position and at the same time steer the craft with the use of the handlebars that are attached to the rudder. The gear means that operatively connect the second shaft with the third shaft comprises a bevel gear mounted on the second shaft adjacent the second sprocket. A second bevel gear mounted on the third shaft is located in driving engagement with the first bevel gear so that on rotation of the second shaft in response to rotation of the first shaft, the propeller rotates.

The frame includes a transverse member having an inside cylindrical surface having a transverse access surrounding a bore. The housing has a laterally directed hub that is extended into the bore. A sleeve of elastic material is interposed between the hub and the inside cylindrical surface and operates to allow selective rotation of the housing relative to the transverse member from a down location to an up location. The first shaft extends through the hub and is connected to the foot operated drive. A stop mounted on the structure that supports the frame on the cross bars engages the housing to hold the housing in its down location and prevent forward pivotal movement of the housing during forward movement of the watercraft. The sleeve of elastic material is deformed into engagement with the inside cylindrical surface of the transverse member upon rearward operation of the foot operated drive to prevent rearward pivotal movement of the housing and propeller whereby the watercraft can be moved in reverse direction. The sleeve of elastic material allows the housing to be pivoted from its down location to its up location when the foot operated drive is not used.

The foot operated drive includes an endless link chain and sprocket drive connected to crank arms having foot pedals that are used to rotate the drive sprocket and thereby move the endless link chain. A chain guard has plate members located adjacent opposite sides of the chain to prevent foreign objects and clothing from interfering with the operation of the chain and sprockets. The chain guard is secured to the frame of the watercraft. A sprocket accommodating the endless link chain is connected to the first shaft that is located in a bore off-center relative to the axis of the inside cylindrical surface of the transverse member which is the pivotal axis of the housing. When the housing is in the down location, the endless link chain is in a tension drive condition. When the housing is moved to the up location, the endless link chain is in a loose condition to allow the endless link chain to be removed from its associated sprockets.

The propeller of the watercraft has a central hub having a pocket accommodating the outer end of the third shaft. The propeller is driveably connected to the third shaft and includes a plurality of outwardly directed blades joined to the hub. Each blade has a leading edge having a broad convex curved-shape terminating in a convex outer end. The forward surface of each blade has a transverse convex shape to facilitate laminar flow of water over the forward surface and establish a forward thrust to aid in propelling the watercraft. A convex-shaped trailing lobe is located adjacent the hub. The trailing edge of the blade is convex-curved and extends from the lobe to the outer convex outer end. The forward and aft surfaces of the blade extend between the leading and trailing edges and have helical curvatures and pitch angles that increase from the hub to the outer end of the blade. In a preferred embodiment, in the pitch of the propeller, the pitch angles increase from about 20 degrees at the hub to about 70 degrees at the outer end of the blade.

The watercraft is strong in construction and durable in use. The propeller and rudder can be moved to up, non-operative locations to facilitate the transport and storage of the watercraft. The propeller has a structure that is strong and that withstands forces without causing blade fracture and a shape that minimizes cavitation so as to produce maximum thrust in relation to the power input.

DESCRIPTION OF PREFERRED EMBODIMENT

Referring to FIGS. 1 to 4, there is shown a personalized watercraft indicated generally at 30. Craft 30 is a human powered pontoon-type catamaran boat having a pair of elongated floatation units or floats 31 and 32 joined together with cross tube or bars 33 and 34. A drive and steering apparatus, indicated generally at 36 mounted on the mid-sections of cross bars 33 and 34 operates to propel and steer craft 30 as herein described. Watercraft 30 incorporates the exercise and enjoyment of bicycling to the water. Watercraft 30 is useable for adventure, exploration and fishing, in addition to endurance, muscle tone and cardiovascular workout. Use of watercraft 30 is compatible to the environment as it is quiet in operation and does not contribute to air or water pollution.

Figure 5:
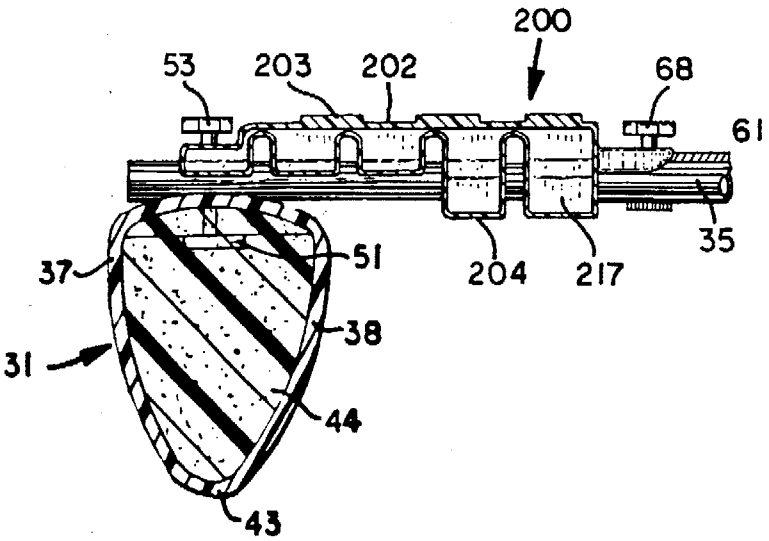
FIG. 5 is an enlarged sectional view taken along the line 5—5 of FIG. 1.

Floatation units 31 and 32 are identical and are releasably attached to opposite ends of cross bars 33 and 35. The following detailed description is limited to floatation unit 31. The corresponding structure of floatation unit 32 has the same reference numerals with the suffix A. Referring to FIG. 5, floatation unit 31 has longitudinally elongated side convex-shaped walls 37 and 38 joined to an elongated convex-shaped top wall 39. Returning to FIG. 1, convex-curved walls 37, 38 and 39 converge forwardly to a convex-curved bow 41 and converge rearwardly to a convex-curved stern 42. Side walls 37 and 38 converge downwardly to an elongated central convex-curved keel 43. The interior chamber of floatation unit 31 is filled with a core 44, such as foam plastic including, but not limited to, polystyrene and polyurethane. Other types of light-weight core materials can be located within floatation unit 31. Floatation unit 31 can be an enclosed hollow structure having an enclosed chamber accommodating only air.

Returning to FIG. 1, horizontal platforms 200 and 201 are attached to bars 33 and 34 on opposite sides of drive and steering apparatus 36. Platforms 200 and 201 are identical side decks located adjacent opposite sides of the frame of the watercraft. The details of platform 200 are shown in FIGS. 16 to 21 hereinafter described. The platforms 200 and 201 function as foot supports for the driver of watercraft 30.

Figure 6:
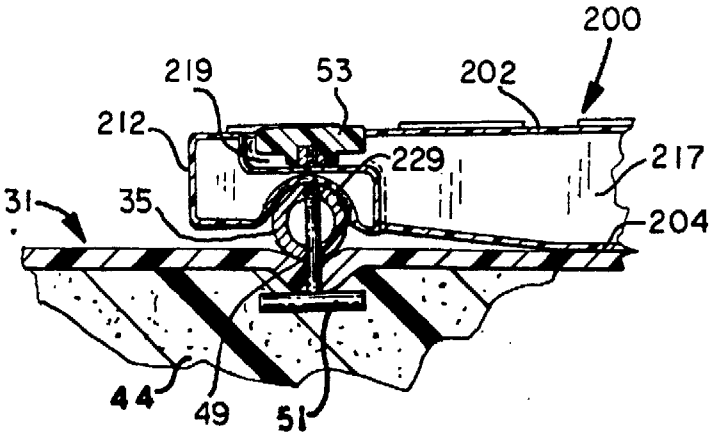
FIG. 6 is an enlarged sectional view taken along the line 6—6 of FIG. 1.

Top wall 39 has a pair of transverse grooves or recesses 47 and 48 that accommodate the ends of cross bars 33 and 35. As shown in FIG. 6, cross bar 35 fits into groove 48 and engages the transverse sides as well as the bottom of groove 48. A bolt 49 having a head 51 located within floatation unit 31 projects upwardly through a hole in cross member 35. A combined knob and nut 53 is threaded on bolt 49 to secure cross bar 35 to floatation unit 31 and platform 200 to cross bar 35 as shown in FIG. 6. A second combined knob and nut 68 threaded on a bolt extended through a hole in cross member 35 secures the inside of platform 200 to cross member 35. Combined knob and nut 53 can be released thereby allowing the cross bar 35 and platform 200 to be removed from floatation unit 31. Combined knob and nut 56 secures the opposite end of cross bar 35 to a threaded bolt (not shown) on floatation unit 32. Combined knob and nuts 57 and 58 secure the opposite ends of cross bar 33 to floatation units 31 and 32. The nut and bolt structures associated with knobs 56, 57 and 58 are identical to that shown in FIG. 6.

Figure 16:
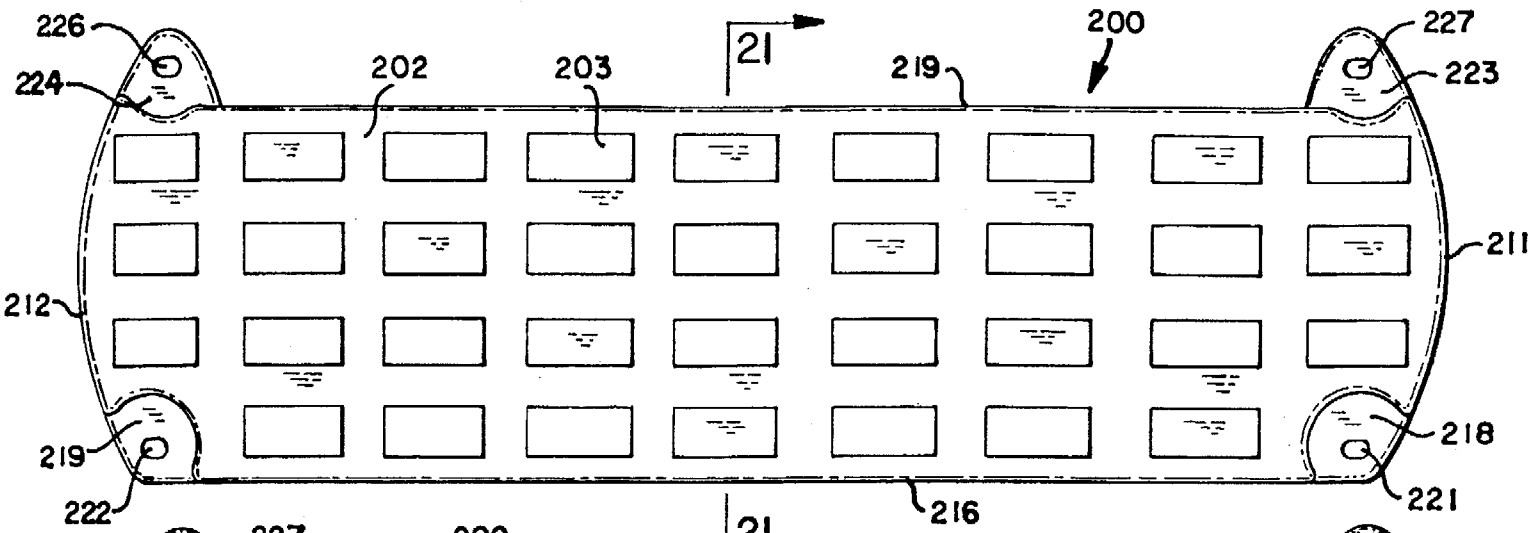
FIG. 16 is a top plan view of a platform of the watercraft of FIG. 1.
Figure 17:
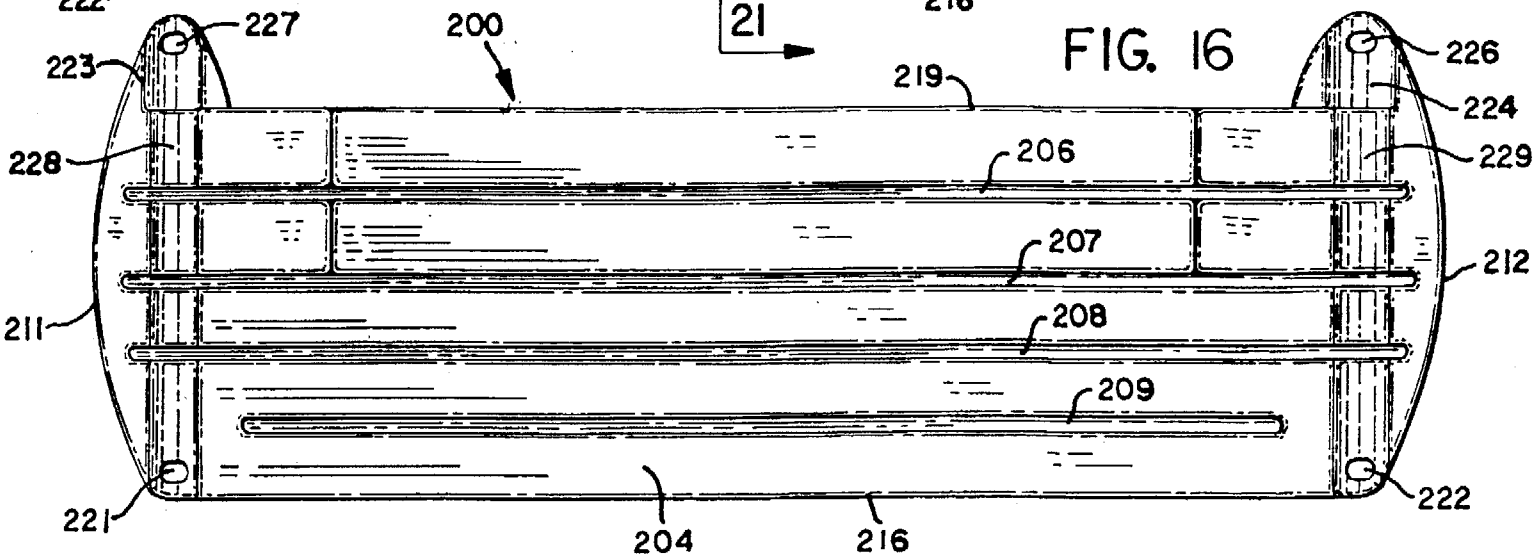
FIG. 17 is a bottom plan view of FIG. 16.

As shown in FIGS. 16 to 21, platform 200 has a top wall or deck 202 with skid resistant surfaces 203 to minimize sliding and slipping of a watercraft rider. Surfaces 203 are generally rectangular pads raised a short distance above deck 202 to minimize collection of water on surfaces 203 and allow water to drain off deck 202. As shown in FIG. 17, bottom wall 204 of platform 200 has four longitudinal grooves 206–209 extended between opposite convex curved ends 211 and 212 of platform 200. Bottom wall 204 has a plurality of upright ribs 213, shown in FIG. 21, that provide longitudinal strength to the platform. Side walls 214 and 216 join adjacent sides of deck 202 and bottom wall 204. Ends 211 and 212 join adjacent ends of deck 202 and bottom wall 204 to enclose internal chamber 217 and trap air therein. Chamber 217 can be filled with foam plastic.

The outside corners of platform 200 adjacent ends 211 and 212 have recesses or pockets 218 and 219 with holes 221 and 222, respectively, for the bolts that extend upwardly from cross bars 33 and 35. Knobs 53 and 56 located in pockets 218 and 219 have top portions that are flush with the top of deck 202 to minimize projections that can trip the rider of watercraft 30. The inside corners of platform 200 have inwardly directed ears 223 and 224 with holes 226 and 227, respectively, for the bolts that accommodate knobs 66 and 68. The ears 223 and 224 have top surfaces located below the level of deck 202 to position knobs 66 and 68 below deck 202 to eliminate projections that can interfere with the rider.

Figure 7:
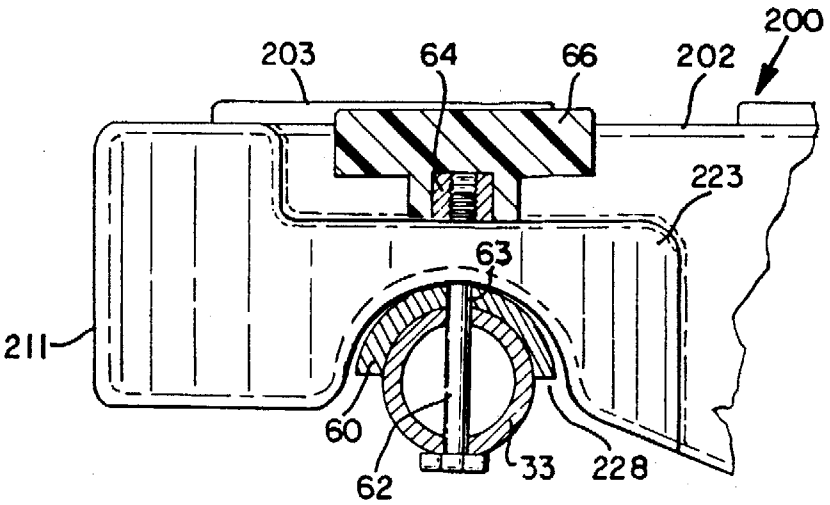
FIG. 7 is an enlarged sectional view taken along the line 7—7 of FIG. 1.
Figure 18:
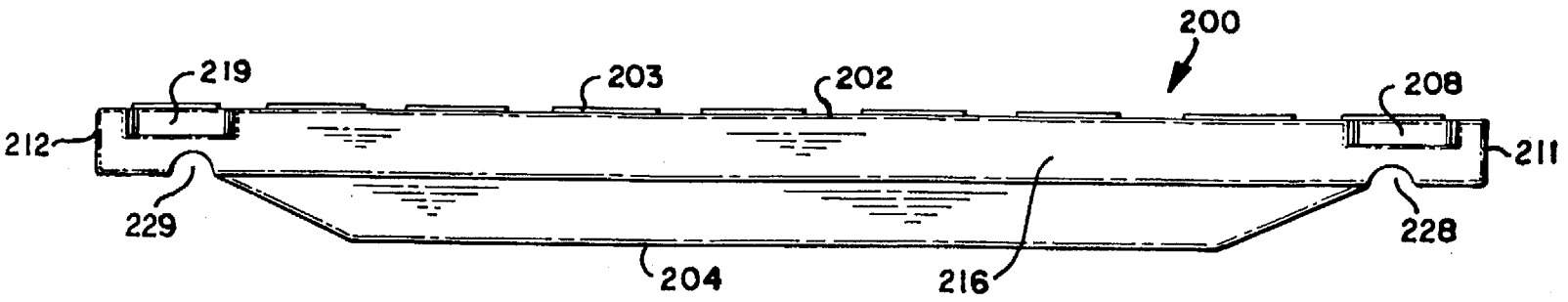
FIG. 18 is a side elevational view of the outside of the platform of FIG. 16.
Figure 19:
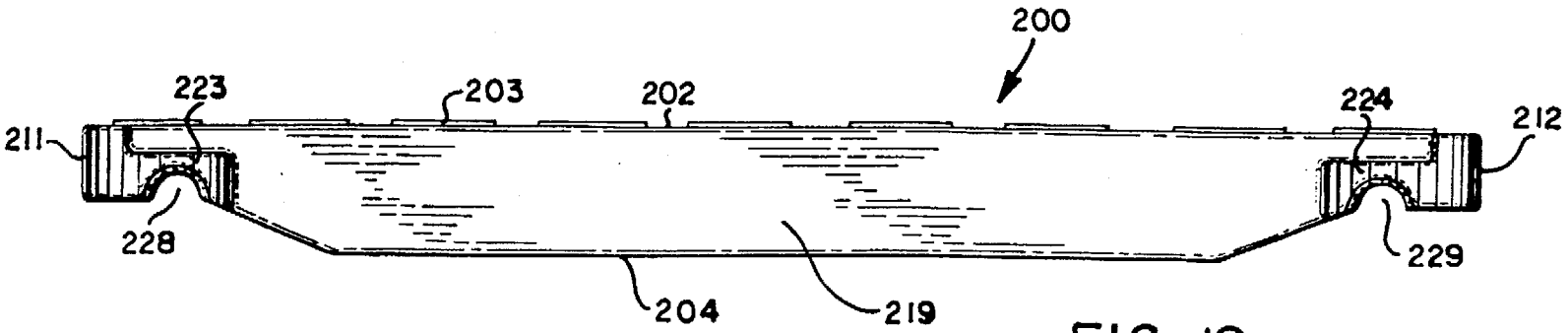
FIG. 19 is a side elevational view of the inside of the platform of FIG. 16.
Figure 21:
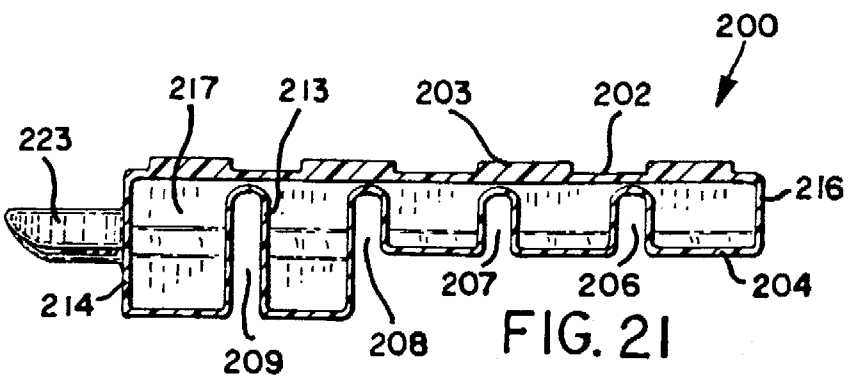
FIG. 21 is an enlarged sectional view taken along the line 21—21 of FIG. 16.
Figure 20:
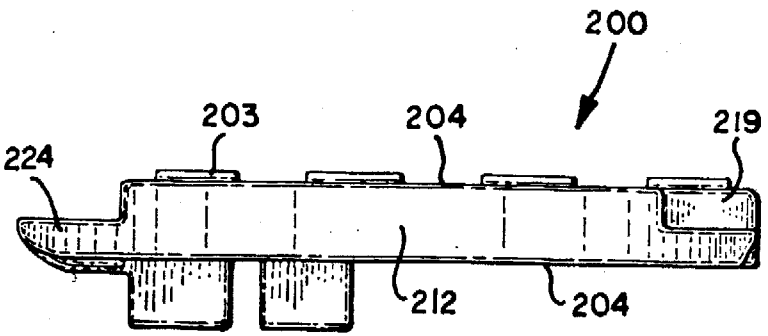
FIG. 20 is an end elevational view of the platform of FIG. 16.
Figure 22:
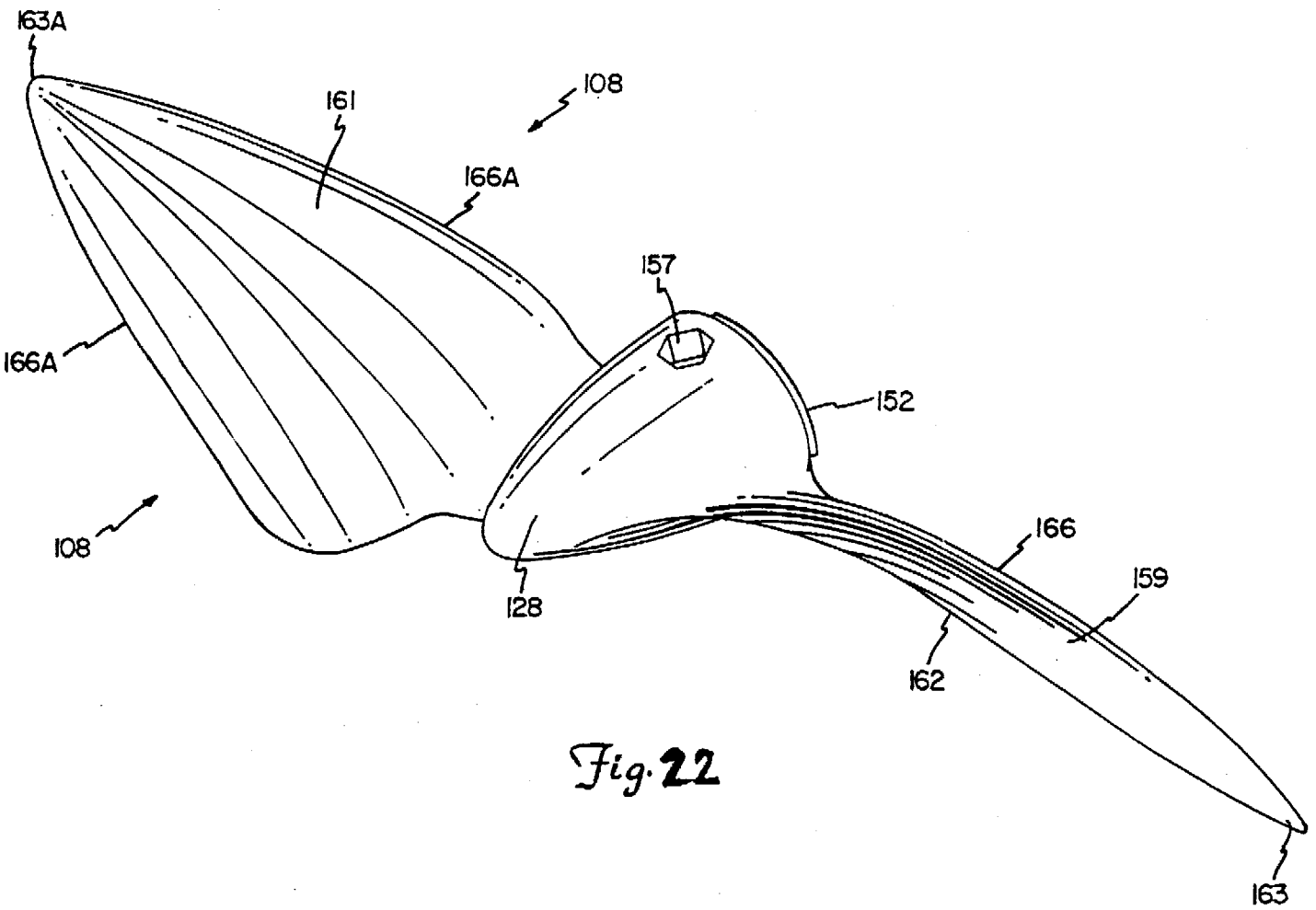
FIG. 22 is a perspective view of the propeller of the watercraft of FIG. 1.
Figure 23:
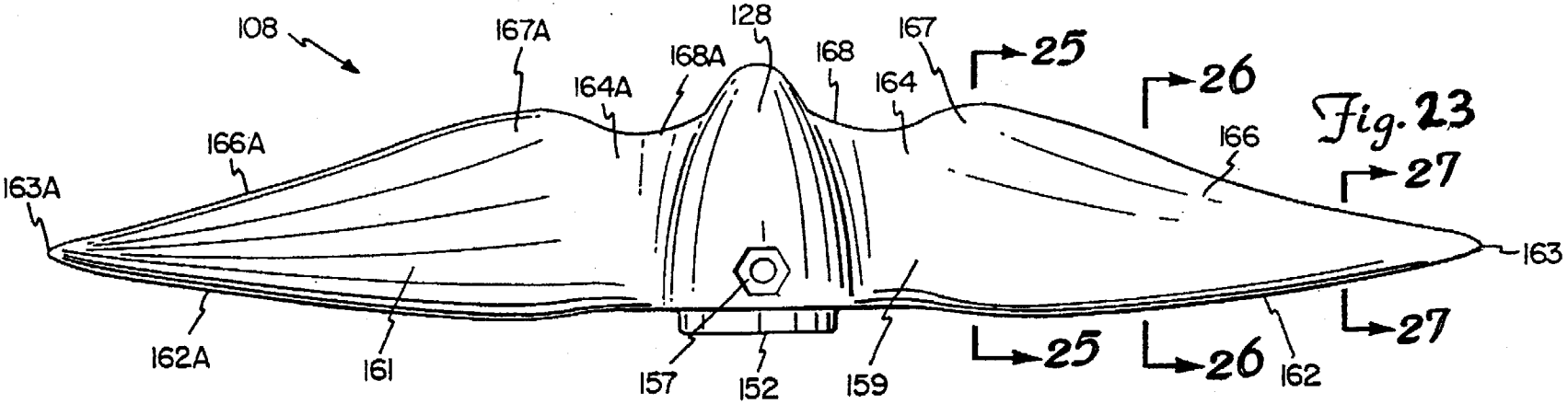
FIG. 23 is a top plan view of the propeller of FIG. 22.

As shown in FIGS. 17 to 19, opposite end portions of bottom wall 204 have transverse and inverted U-shaped channels or grooves 228 and 229 for accommodating cross bars 33 and 35. As shown in FIG. 6, cross bar 35 is located in channel 229 and knob 53 is located in pocket 219. Bolt 49 connects cross bar 35 to pontoon 31 and platform 200 to cross bar 35. As shown in FIG. 7, cross bar 33 and member 60 are located in groove 228. Knob 66 and nut 64 threaded on bolt 62 secure platform 200 to cross bar 33. Knob 68 and ear 224 have the same structure as shown in FIG. 7.

Figure 1:
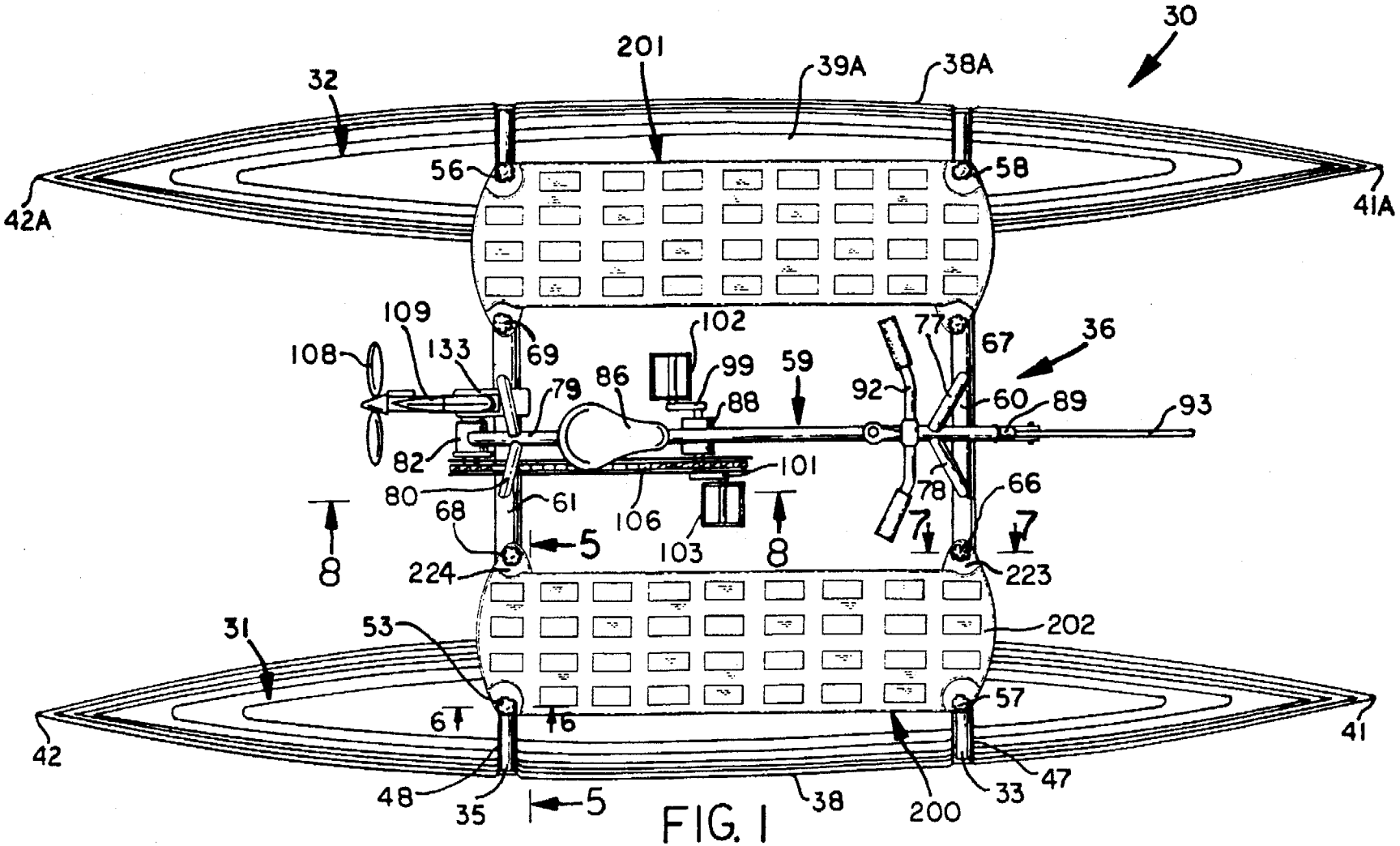
FIG. 1 is a top plan view of the watercraft of the invention.

Drive and steering apparatus 36 has a frame, indicated generally at 59, that is longitudinally located between cross bars 33 and 34 and between platforms 200 and 201. Frame 59 has a pair of transverse U-shaped members 60 and 61 that fit on top of the midsections or cross bars 33 and 35. As shown in FIG. 7, inverted U-shaped member 60 is secured to cross bar 33 with an upright bolt 62 mounted on cross bar 33 and extended upwardly through a hole 63 in U-shaped member 60. A nut 64 joined to knob 66 is threaded onto the upper end of bolt 62 to secure the inverted U-shaped member 60 and platform 200 on top of cross bar 33. As seen in FIG. 1, knob 67 secures the opposite end of inverted U-shaped member 60 to cross bar 33. A pair of knobs 68 and 69 associated with nuts and bolts secure U-shaped member 61 to cross bar 35 and platforms 200 and 201 to member 61. The connecting structures associated with knobs 67, 68 and 69 are identical to that shown in FIG. 7.

Figure 2:
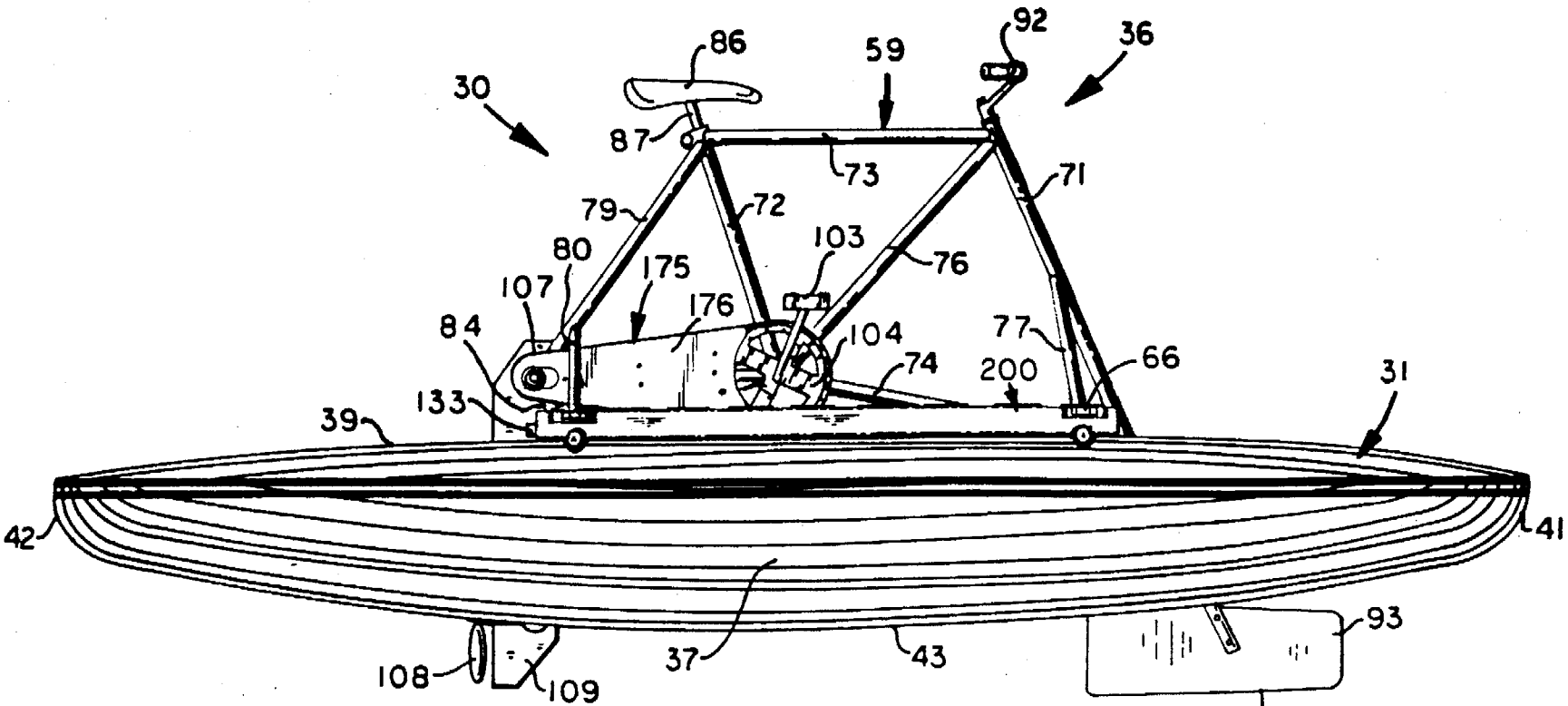
FIG. 2 is a side elevational view thereof.

Referring to FIG. 2, frame 59 has a front upright tube 71 and a rear upright tube 72 joined to longitudinal upper and lower tubes 73 and 74. A diagonal tube 76 extends downwardly and rearwardly from forward tube 71 to the lower end of rear tube 72. A pair of downwardly and outwardly directed braces 77 and 78 secured to opposite portions of inverted U-shaped member 60 stabilize front tube 71 relative to inverted U-shaped member 60. A short tube 91 connects member 60 to the lower end of tube 71. A downwardly diagonal tube 79 and horizontal tube 81 are joined to a transverse cylindrical member 82 providing a housing for the propeller drive assembly, as hereinafter described. Braces 80 secured to tube 79 are joined to member 61 to stabilize member 79. A pair of tubes 84 join cylindrical member 82 and a cylindrical housing 88 to inverted U-shaped member 61. A seat 86 is located above the upper end of tube 72 and is joined thereto with a downwardly directed rod 87. Seat 86 can be vertically adjusted to accommodate different persons.

Figure 3:
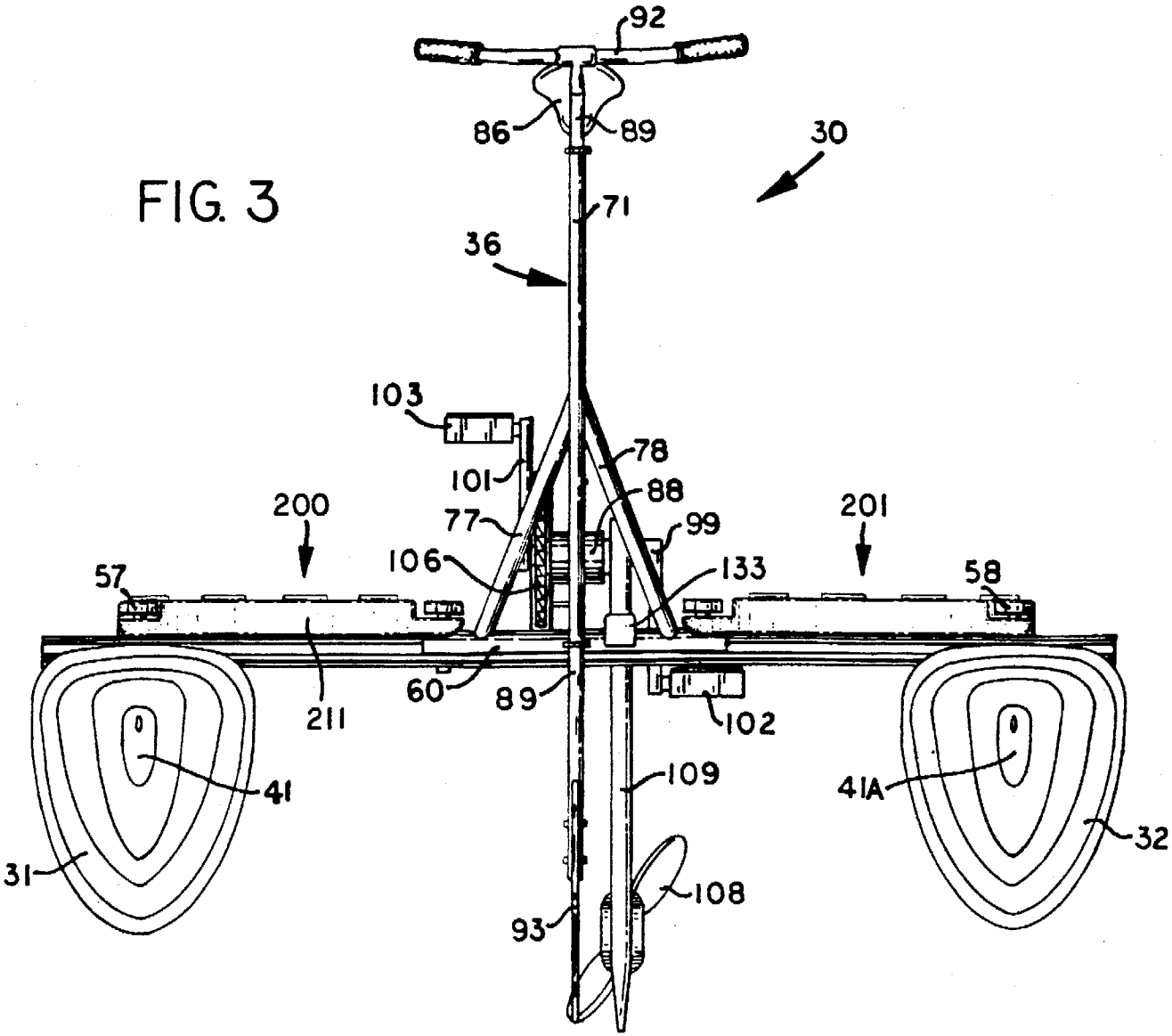
FIG. 3 is a front elevational view thereof.
Figure 4:
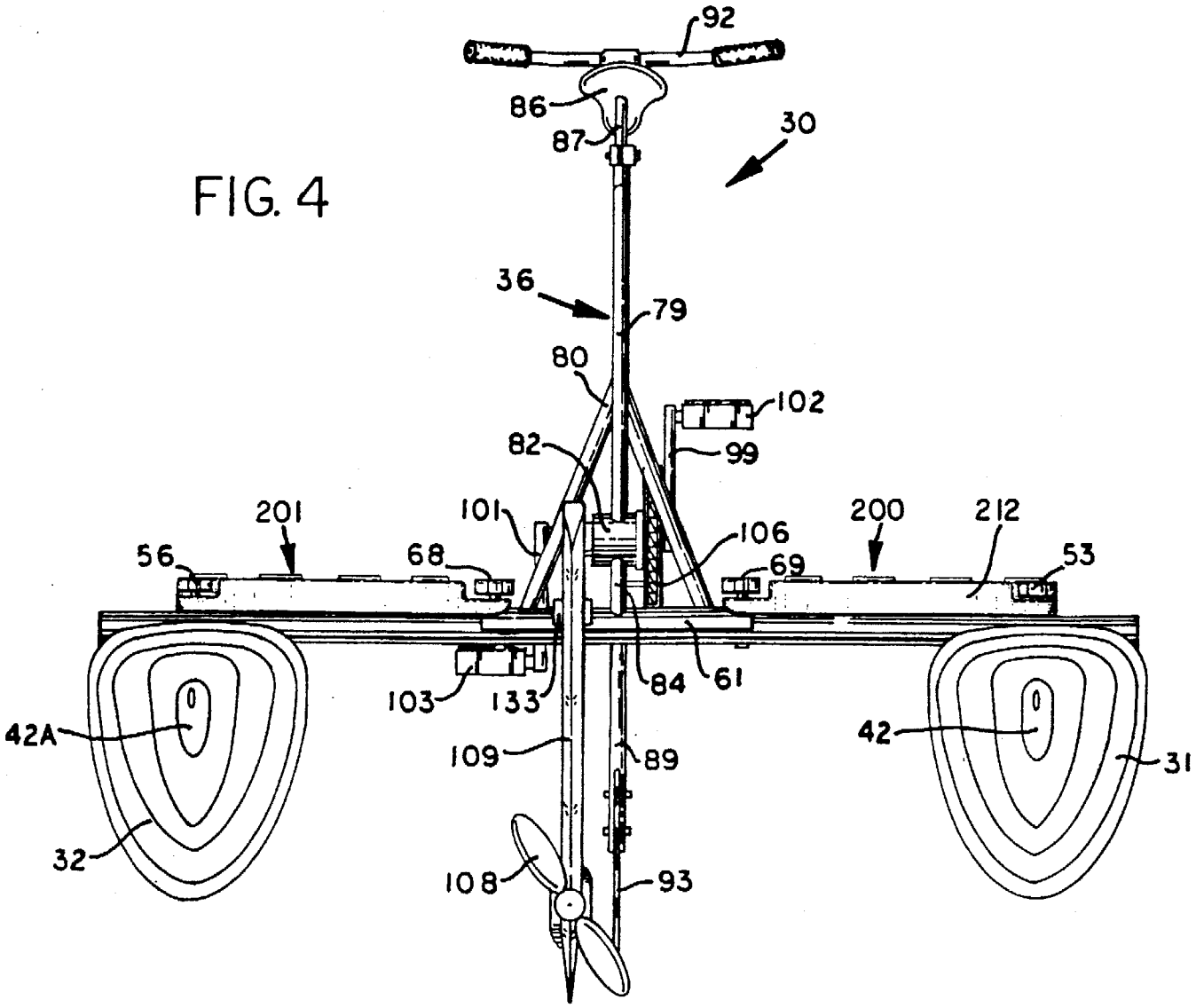
FIG. 4 is a rear elevational view thereof.

As seen in FIG. 3, an elongated cylindrical rod or shaft 89 telescopes through front upright tube 71 and is connected at its upper end with a handlebar stem to conventional bicycle handlebars 92. The lower end of rod 89 is secured to a generally flat rudder 93. Rudder 93 has a generally rectangular shape with a downwardly and rearwardly directed keel or lower edge 94. Rod 89 is secured to the general middle portion of the top of rudder 93 so that handlebars 92 can be used to turn rudder 93 about the axis of shaft 89. Rudder 93 can be moved from a lower position below floats 31 and 32 to a raised position between floats 31 and 32. Releasable holding structures are used to hold rudder 93 in the up, locked position.

Figure 8:
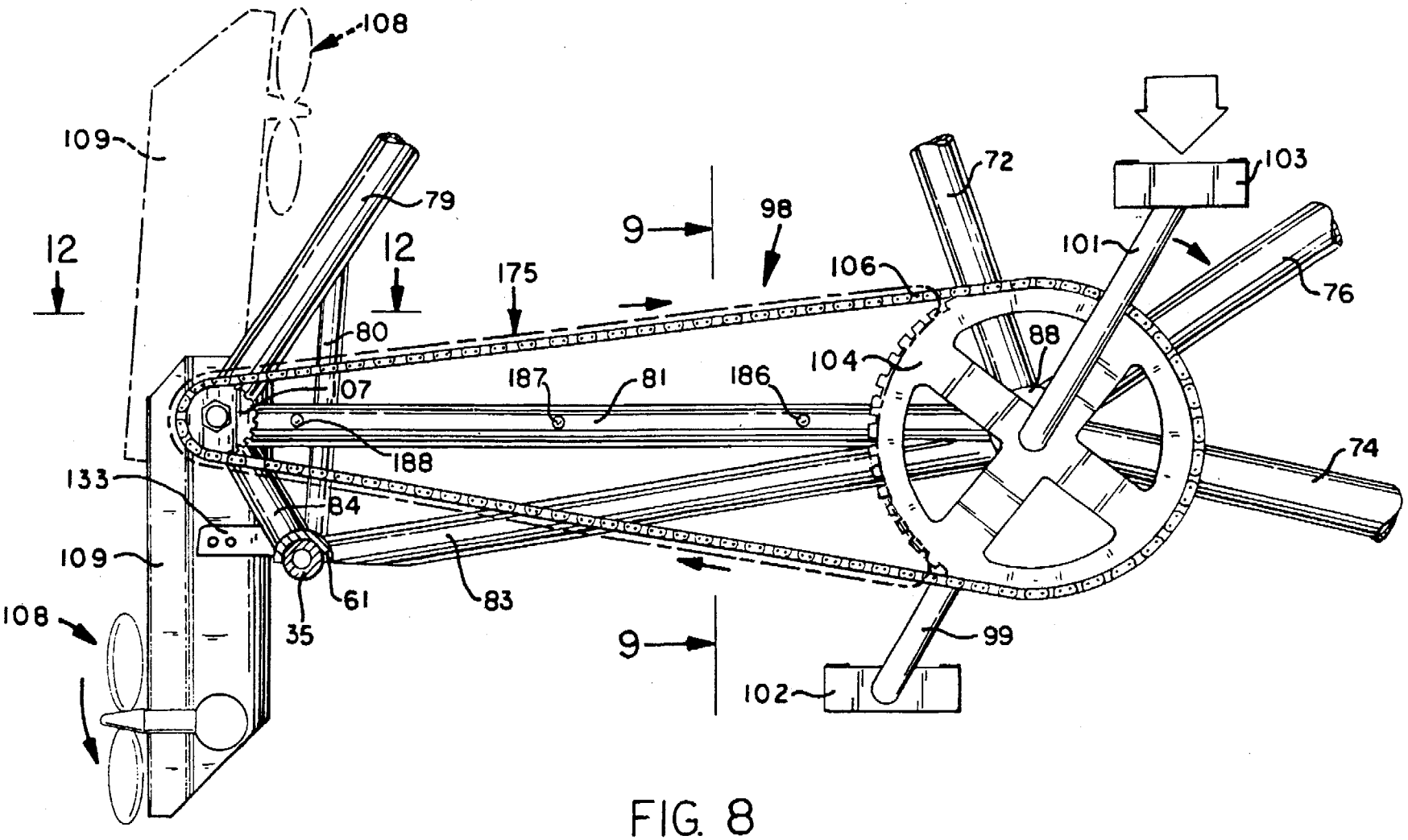
FIG. 8 is an enlarged sectional view taken along the line 8—8 of FIG. 1.
Figure 12:
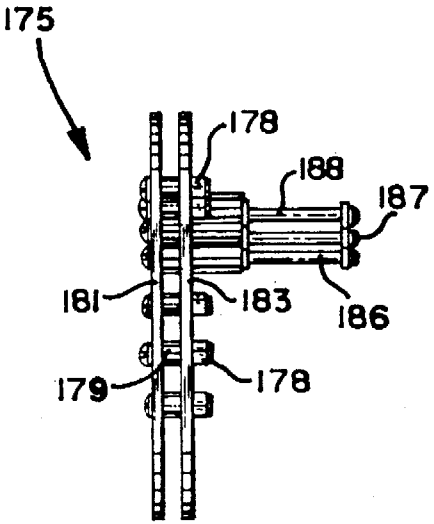
FIG. 12 is an end view of the fight end of the chain guard of FIG. 10.
Figure 10:
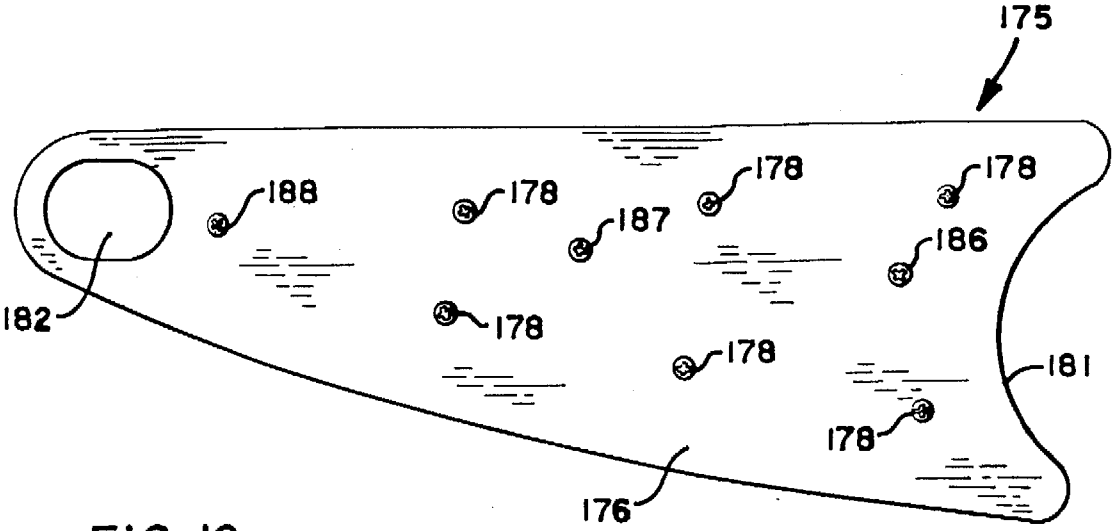
FIG. 10 is a side elevational view of the outside of the chain guard of the watercraft of FIG. 1.
Figure 11:
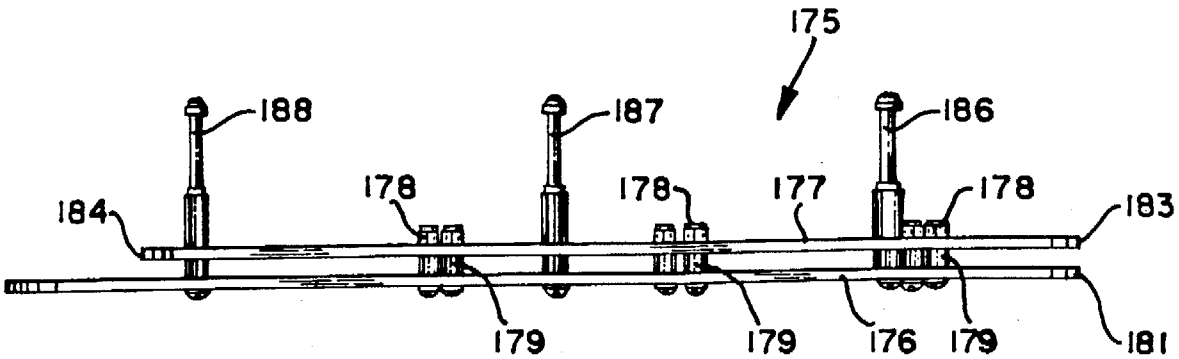
FIG. 11 is a top plan view of the chain guard of FIG. 10.
Figure 15:
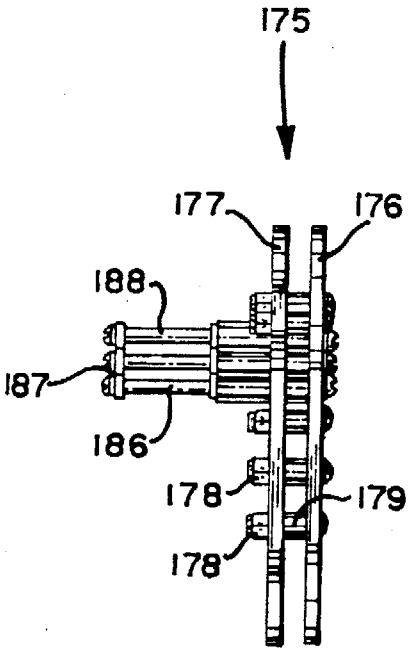
FIG. 15 is an end view of the fight end of the chain guard of FIG. 14.
Figure 13:
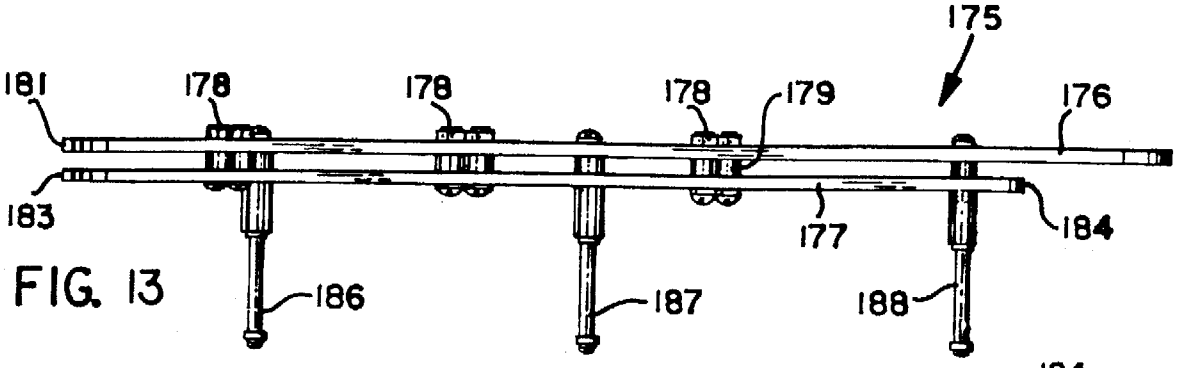
FIG. 13 is a bottom plan view of the chain guard of FIG. 10.

Referring to FIG. 8 and 32 to 35, there is shown the drive train for rotating propeller 108, indicated generally at 98. Drive train 98 is a foot operated drive including crank arms 99 and 101 journaled within cylindrical housing 88. Foot pedals 102 and 103 are rotatably mounted on the outer ends of crank arms 99 and 101 about the axis of cylindrical housing 88 by the operator of the watercraft. A large drive sprocket 104 secured to crank arm 101 accommodates a roller link chain 106, which is also trained about a driven sprocket 107. As shown in FIG. 8, sprocket 104 has an elliptical shape with a major axis circumferentially off-set from crank arms 99 and 101 to promote smooth and even foot power input to sprocket 104 and chain 106 trained thereabout.

Figure 14:
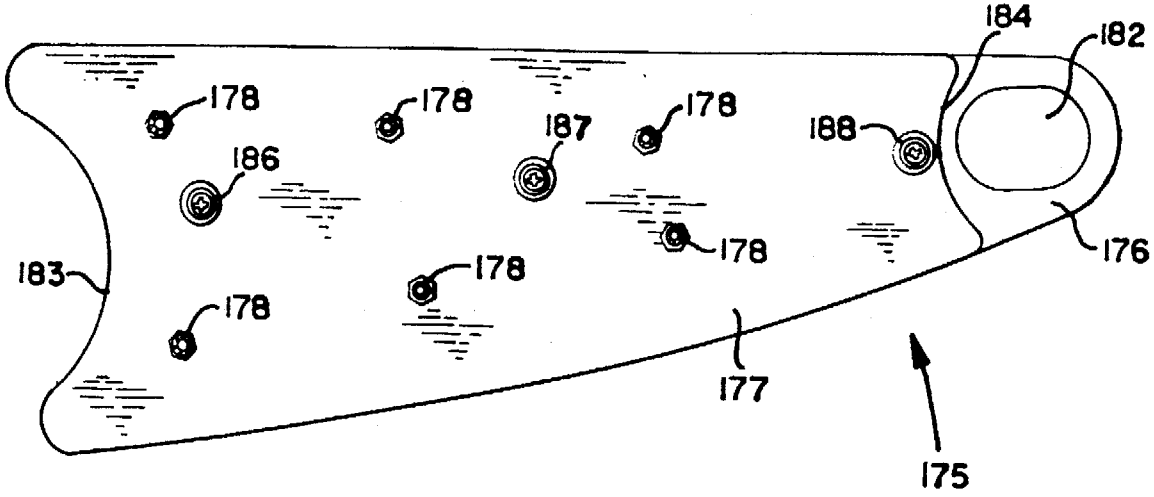
FIG. 14 is a side elevational view of the inside of the chain guard of the watercraft of FIG. 1.

A chain guard, indicated generally at 175, covers opposite sides of the upper and lower runs of chain 106, driven sprocket 107 and a rear portion of drive sprocket 104, as shown in broken lines in FIG. 8, to eliminate outside interference with the operation of chain 106 on sprockets 104 and 107. As shown in FIGS. 11, 12, 13 and 15, chain guard 175 has an outside flat plate 176 and an inside flat plate 177 secured together in lateral spaced relationship with a plurality of nut and bolt assemblies 178. Spacers 179 accommodated by nut and bolt assemblies 178 are located between plates 176 and 177 to maintain a fixed lateral spaced relationship of plates 176 and 177. This space is greater than the width of chain 106 so that chain 106 does not rub nor catch on plates 176 and 177 when it is driven in opposite directions. Chain 106 can be removed from sprockets 104 and 107 without removing or repositioning chain guard 175. Plate 176 has a concave forward end 181 and an oblong opening 182 in the rear portion thereof. Inside plate 177, shown in FIG. 14, has a concave forward end 183 having the same concave curve as end 181 of plate 176. The rear end 184 of plate 177 has a concave curve and is shorter than plate 176.

Figure 9:
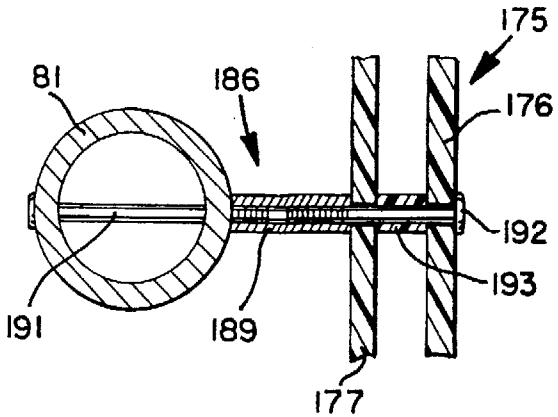
FIG. 9 is an enlarged sectional view taken along the line 9—9 of FIG. 8.

A plurality of connectors 186, 187 and 188 secure chain guard 175 to frame member 81. Connectors 186, 187 and 188 are identical. FIG. 9 shows the details of connector 186. Connector 186 has a tubular member or sleeve 189 laterally spacing chain guard 175 from frame member 81 and aligning chain 106 between plates 176 and 177. A bolt 191 extended through holes in frame member 81 is threaded into sleeve 189 to secure sleeve 189 to frame member 81. A second bolt 192 extended through holes in plates 176 and 177 is threaded into the opposite end of sleeve 189 to secure plates 176 and 177 to sleeve 189. A tubular spacer 193 located between plates 176 and 177 surrounds bolt 192 to maintain the fixed spaced relationship of plates 176 and 177.

Figure 34:
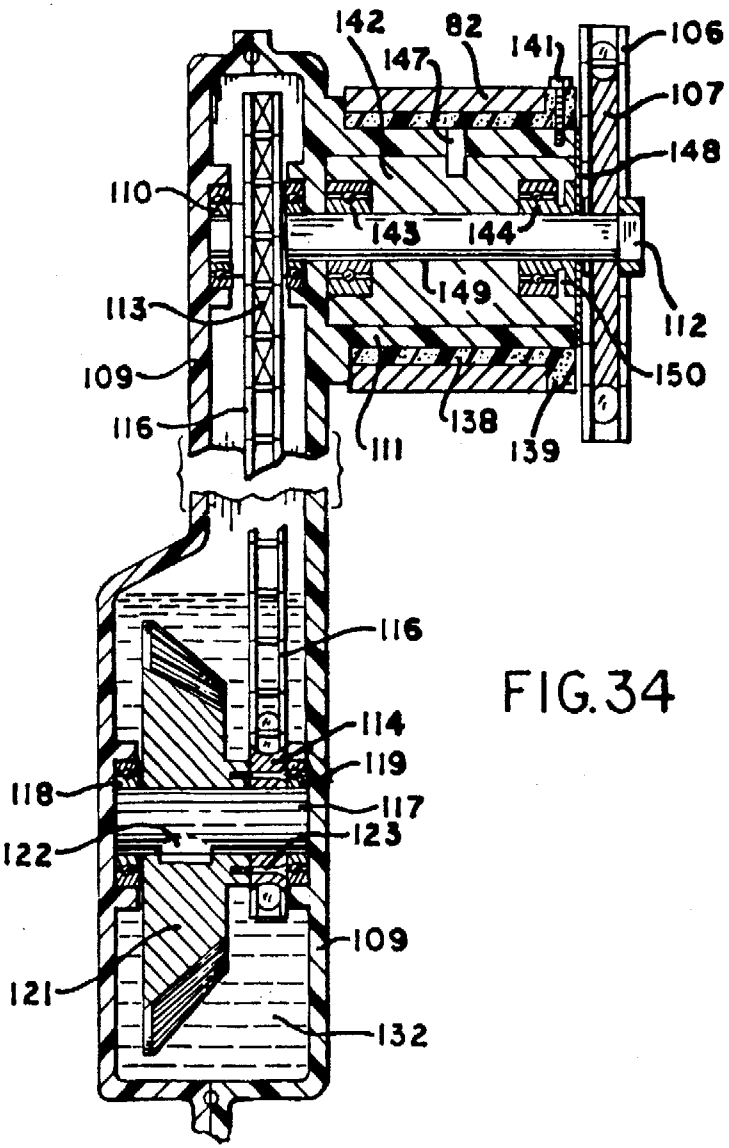
FIG. 34 is an enlarged sectional view taken along the line 34—34 of FIG. 32.

Propeller 108 is rotatably mounted on a relatively narrow vertical housing 109. Housing 109 has a small front area to reduce drag when moved through the water. The upper end of housing 109 has a lateral hub 111 rotatably mounted on cylindrical member 82 to allow housing 109 to move from a down drive location, as shown in FIG. 8, to an up, release location, as shown in broken lines in FIG. 8. As seen in FIG. 34, a transverse shaft 112 rotatably mounted within cylindrical member 82 is splined to sprocket 107. Shaft 112 extends into the upper end of housing 109 and is journaled thereon with bearings 110. An upper sprocket 113 is secured to shaft 112 and accommodates a roller-linked chain 116. Chain 116 is trained about a lower sprocket 114, secured to a transverse shaft 117. Shaft 117 is journaled with bearings 118 and 119 mounted on housing 109. A bevel gear 121 is keyed with a key 122 to shaft 114 adjacent sprocket 117. Bolts 123 secure sprocket 114 to bevel gear 121. Other structures, including brazing, can be used to join sprocket 114 with bevel gear 121. Sprocket 114 and gear 121 can be a one-piece sprocket and gear.

Returning to FIGS. 33 and 35, a second small bevel gear 124 is located in driving engagement with bevel gear 121. Gear 124 is secured to horizontal shaft 126 located in the horizontal plane of shaft 117. Shaft 126 is rotatably mounted on a bearing 127 mounted in housing 109. Bevel gear 121 is larger in diameter than sprocket 114 so that bevel gear 124 is horizontally aligned with sprocket 114. the teeth of bevel gear 121 face sprocket 114. This bevel gear and sprocket arrangement is a compact drive that does not materially increase the width of the lower end of housing 109 and does not materially add to the drag of housing 109 in the water. The outer end of shaft 126 extends rearwardly from housing 109 and accommodates propeller 108. Propeller 108 has a cone-shaped hub 128 having a central opening or pocket accommodating the end of shaft 126. A bolt 129 extended through a hole 131 in shaft 126 secures propeller 108.

Returning to FIG. 1, a stop member 133 is secured to member 61 in alignment with housing 109. Stop member 133 fixes the vertical position of housing 109 on forward movement of the watercraft. Stop member 133 has rearwardly directed laterally spaced side portions providing a pocket for the forward portion of housing 109 below the axis of shaft 112. A plastic or low friction liner 137 is located in the pocket to allow housing 109 to be pivoted to its up location, as shown in broken lines in FIG. 8. When housing 109 is moved to its up location, it is positioned behind frame 59 thereby placing housing 109 and propeller 108 in a transport position above cross bar 34 and the float connected thereto.

As shown in FIG. 34, a cylindrical sleeve 138 is interposed between hub 111 and cylindrical member 82. Sleeve 138 has an inner cylindrical surface located in surface engagement with the outer surface of hub 111 and an outer surface located in surface engagement with the inner cylindrical surface of cylindrical member 82. Sleeve 138 is an elastic annular member supporting hub 111 on cylindrical member 82. As seen in FIGS. 16 and 17, sleeve 138 is an elastic cylindrical plastic member. One end of sleeve 138 has an enlarged circular hub 139 accommodating a bolt fastener 141 that secures sleeve 138 to hub 111. When sprocket 107 is not subjected to any force due to chain 106, housing 109 can be rotated to its up location. Sleeve 138 will slide relative to the inside surface of cylindrical member 82. When housing 109 is in its down location, the operator of the watercraft can pedal to actuate the drive train to propel the watercraft in a forward direction. The operator can also reverse the pedaling action on pedals 102 and 103 to move the watercraft in a backward or reverse direction. This will turn propeller 108 in a counterclockwise direction exerting a rearward force on housing 109. This force will tend to rotate housing 109 in an upward direction pulling propeller 108 out of the water. The reverse force on chain 106 applies a forward force on hub 111 which compresses and deforms the plastic material of sleeve 138 into tight frictional engagement with the inside surface of cylindrical member 82, as shown in FIG. 34. The friction force between sleeve 138 and cylindrical member 82 is sufficient to prevent housing 109 from moving in a reverse direction so that propeller 108 will remain in the water during the reverse movement of the watercraft.

Hub 111 surrounds a cylindrical core 142 that accommodates bearings 143 and 144 that rotatably mount shaft 112 for rotation relative to cylindrical member 82. Core 142 can be a non-corrosive metal, such as aluminum or a plastic member, having a cylindrical outer member located in surface engagement with the inner surface of hub 111. As seen in FIG. 34, a pin 147 secures hub 111 to core 142. Other structures can be used to secure hub 111 to core 142. A circular plate 148 secured to the end of core 142 holds a seal 150 adjacent bearing 144.

Core 142 has a bore 149 accommodating shaft 112. Bore 149 is located eccentric or off-center relative to the axis of core 142. Bore 149 is off-center from the axis of the inside surface of housing 109 and the axis of rotation of housing 109. As seen in FIG. 8, when housing 109 is moved to the up location, shaft 112 being located off-center relative to core 142 will move to a forward position thereby moving sprocket 107 forward. The result is that the tension on chain 106 is relieved so that chain 106 can be replaced without breaking chain 106 or removing sprocket 107 from shaft 112. When housing 109 is moved to the down location, shaft 112 will move back to the first position thereby taking up the slack in chain 106 and placing chain 106 in a tension condition.

Referring to FIGS. 22 to 31, there is shown propeller 108 removed from drive shaft 126. Propeller 108 is a two-bladed one-piece structure that has a maximum propelling efficiency and a minimum of thrust losses.

Figure 24:
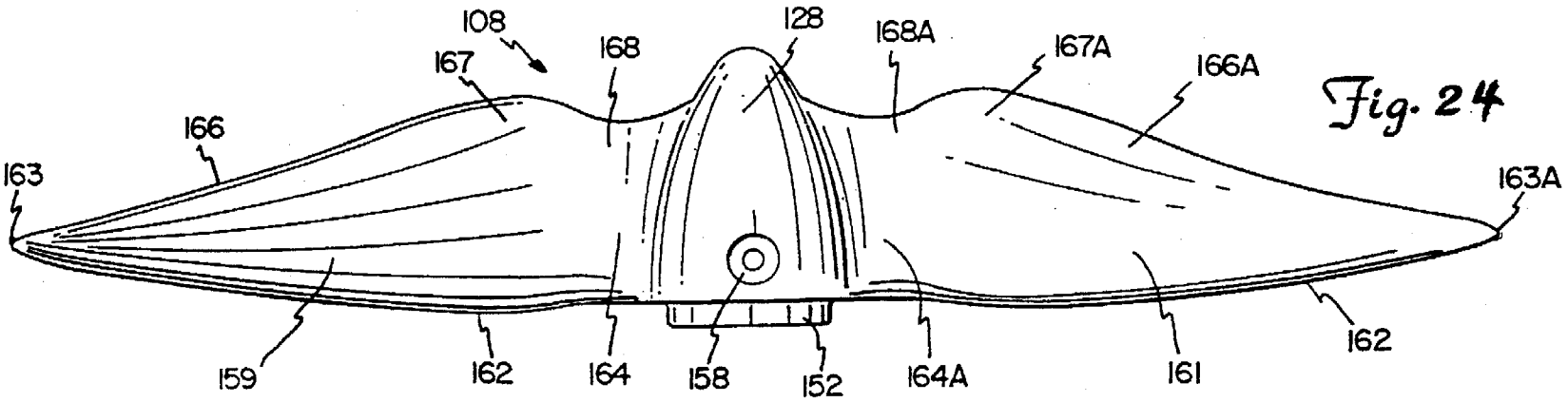
FIG. 24 is a bottom plan view of the propeller of FIG. 22.
Figure 29:
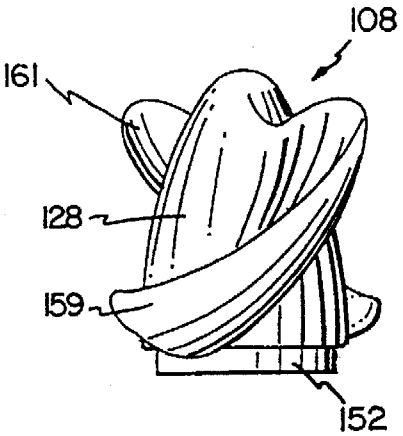
FIG. 29 is an end elevational view of the right end of the propeller of FIG. 22.
Figure 28:
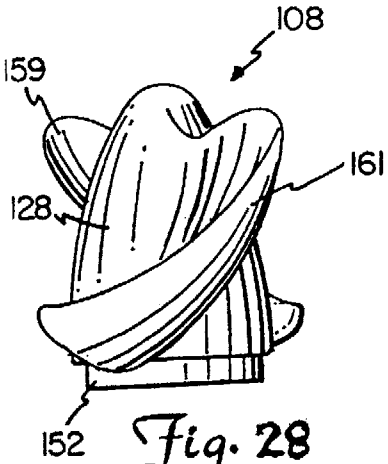
FIG. 28 is an end elevational view of the left end of the propeller of FIG. 22.

Hub 128 has a smooth, generally elongated cone-shaped outer surface having a large forward end and a small hemispherical rear or trailing end. The forward end has a circular forwardly directed lip 152. As seen in FIG. 24, lip 152 has a diameter smaller than the diameter of the outer or large end of hub 128. A plurality of inwardly directed ribs 153, 154 and 155 are joined to hub 128 and lip 152. Ribs 153, 154 and 155 are located within pocket 156 of hub 128 and center propeller 108 relative to the longitudinal rotational axis of shaft 126. The top portion of hub 128 has a hole 157 terminating in a hex-shaped opening. Aligned with hole 157 is a circular hole 158 having an enlarged circular countersunk portion for accommodating a head of bolt or pin 129. The nut for bolt 129 is located in the hex section of hole 157.

A pair of blades 159 and 161 project diametrically away from opposite sides of hub 128. Blades 159 and 161 have identical structures and curvatures so as to provide balanced forces on hub 128 and shaft 126. The following description is directed to blade 159. The corresponding parts of blade 161 have the same reference numerals with the suffix A. Blade 159 has a leading edge 162 having a broad forwardly convex-curved shape terminating in an outer convex end 163. A neck 164 having generally convex outer surfaces joins blade 159 to hub 128. Neck 164 has a thickness throughout its length substantially the same as the thickness of the leading edge 162 of blade 159. Blade 159 has a convex-shaped trailing edge 166 extending from a convex lobe 167 located adjacent neck 164 to end 163. A concave trailing edge 168 extends from the trailing portion of hub 128 to lobe 167.

Figure 26:
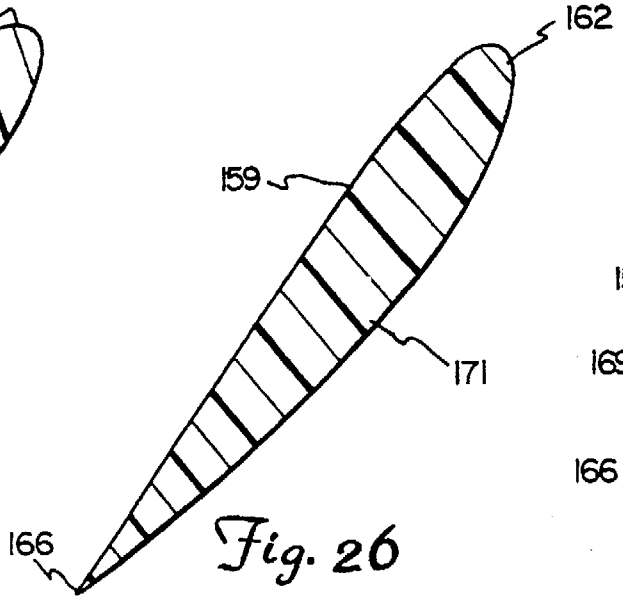
FIG. 26 is an enlarged sectional view taken along the line 26—26 of FIG. 23.
Figure 27:
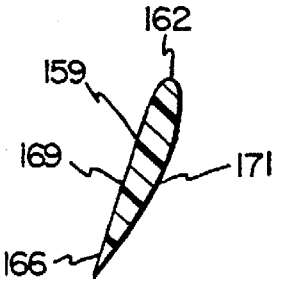
FIG. 27 is an enlarged sectional view taken along the line 27—27 of FIG. 23.
Figure 25:
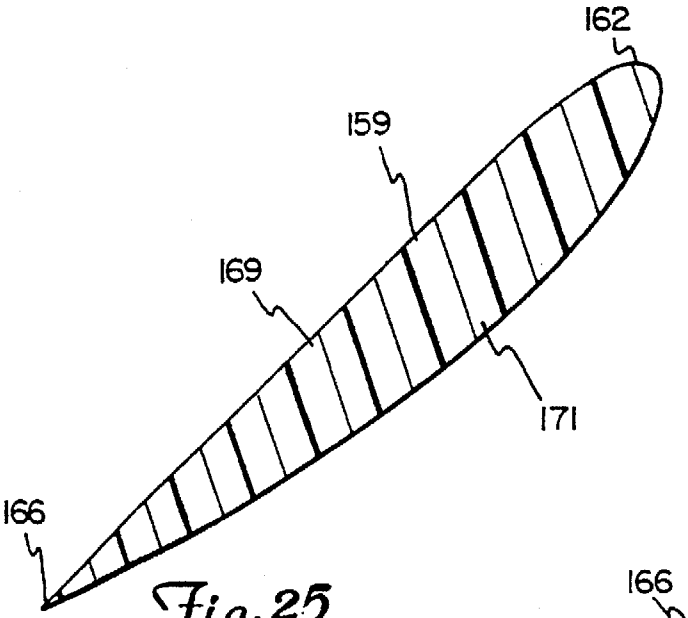
FIG. 25 is an enlarged sectional view taken along the line 25—25 of FIG. 23.
Figure 30:
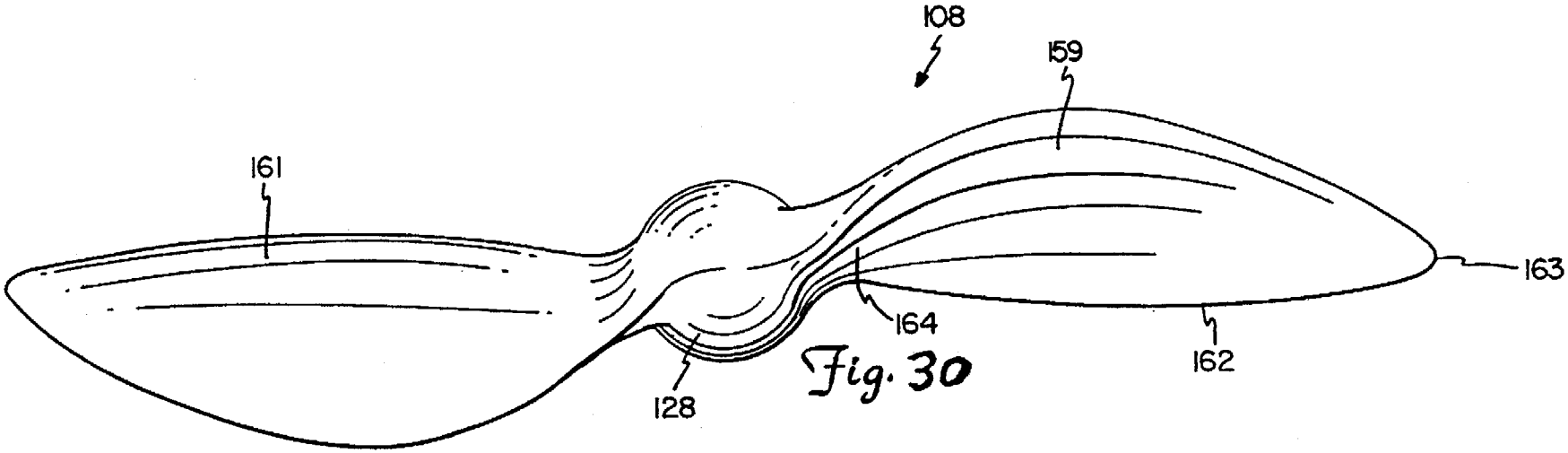
FIG. 30 is a from elevational view of the propeller of FIG. 22.
Figure 31:
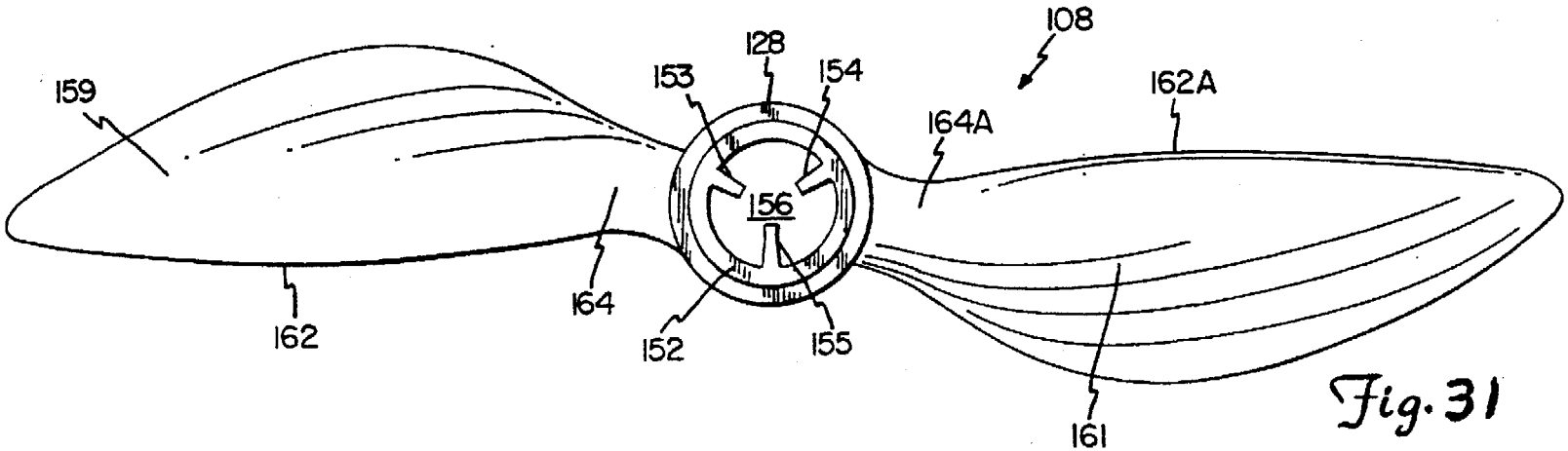
FIG. 31 is a rear elevational view of the propeller of FIG. 22.
Figure 33:
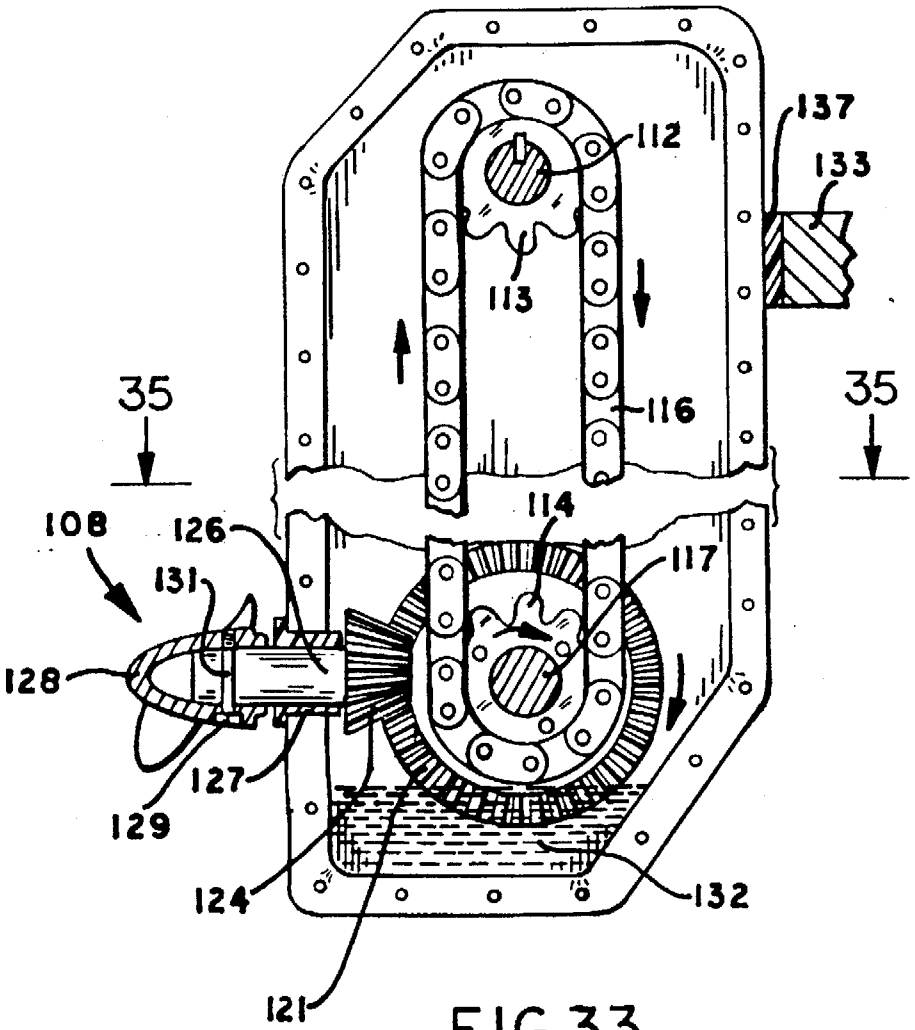
FIG. 33 is an enlarged sectional view taken along the line 33—33 of FIG. 32.
Figure 32:
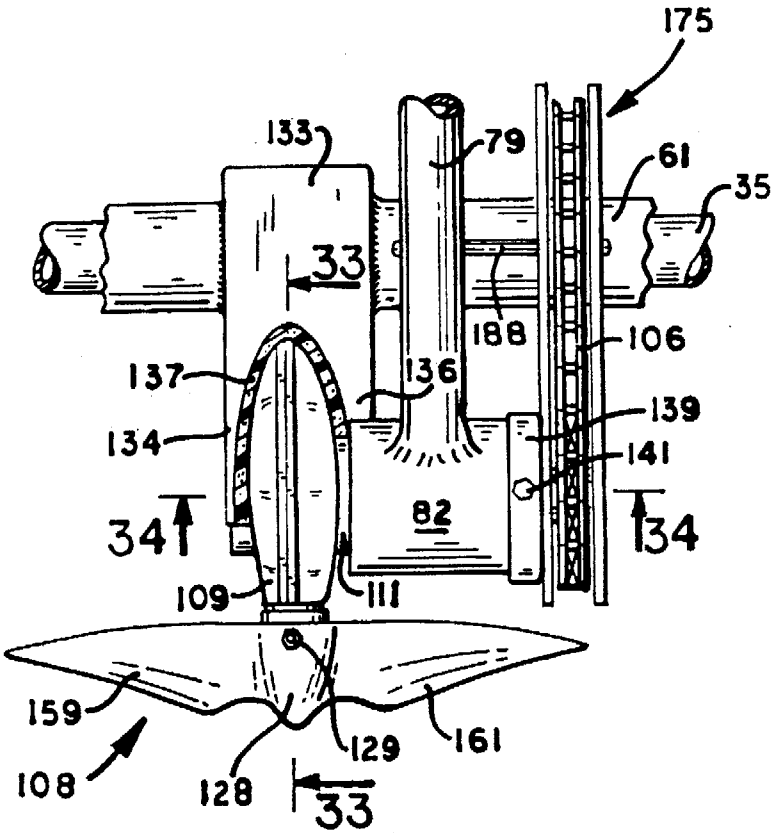
FIG. 32 is a top plan view of the propeller drive assembly of the watercraft of FIG. 1.
Figure 35:
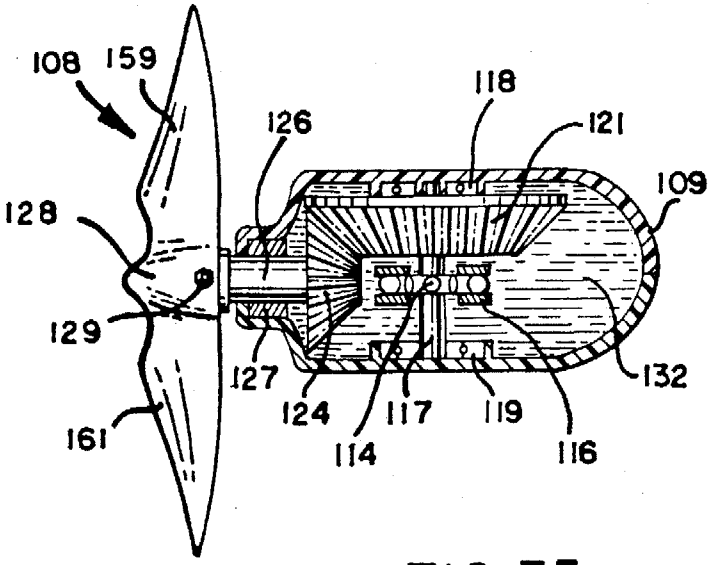
FIG. 35 is a sectional view taken along the line 35—35 of FIG. 33.

As shown in FIGS. 25 to 27, blade 159 is a solid plastic structure having a thickness that decreases toward the trailing edge 166 and has a generally elongated tear-drop shape. The blade is feathered toward trailing edge 166.

Blade 159 has a helical curved rear surface 169 and a forward or front surface 171. Surface 171 has a transverse convex configuration which establishes a forward draft when rotated in water and promotes laminar flow of water over surfaces 169 and 171. The pitch angle of blade 159 varies from about 20 degrees at hub 128 to about 70 degrees at outer end 163. The pitch angle of the section of the blade in FIG. 26 is about 35 degrees. The pitch angle of the blade in FIG. 26 is about 50 degrees. The pitch angle of the section of the blade section shown in FIGS. 27 is 65 degrees. The pitch angle of the blade over its length is a smooth variation or transition from a low pitch angle to a high pitch angle to accommodate the average water speed at each radius and minimize risk of cavitation.

Propeller 108 operates by accelerating the water passing through it, thereby exerting a force thrust by the reaction from the increase in momentum of the accelerated flow. The momentum is achieved by giving an increase in speed of a mass of water. The passage of water sets up pressure reduction on the forward surface of the blade and the pressure increases on the aft side surface of the blade. The largest contribution to the propeller thrust comes from the pressure reduction. If the pressure at any point fails to the pressure at which water vaporizes, then this will cause cavitation which reduces the efficient operation of the propeller. The feathering of the blade and the width of the blade at lobe section 167 restricts the level of pressure reduction and thereby reduces cavitation. The propeller is strong and withstands the forces involved without causing blade fracture and has shapes and curves so as to minimize the harmful effects of cavitation.

While there has been shown and described an embodiment of personalized watercraft, it is understood that changes in the structure and arrangement of structure, materials and parts may be made by one skilled in the art without departing from the invention. The invention is defined in the following claims.

We claim:

1. A watercraft comprising: a plurality of longitudinal float means for supporting the watercraft on a body of water, transverse members extended between and attached to the float means to retain the float means laterally relative to each other, a frame, means mounting the frame on the transverse members, platforms located on opposite sides of the frame, means mounting the platforms on the transverse members, a rudder for steering the watercraft located below said frame, means mounting the rudder on the frame for movement about a generally upright axis to turn said rudder, a propeller, propeller power transmission means mounted on the frame and drivably connected to the propeller for moving said watercraft on said water, the propeller transmission means includes a generally flat and narrow case, said case having an elongated and narrow internal chamber, and an upper end and a lower end, a power input first shaft rotatably mounted on the upper end of the case, said first shaft having a portion thereof located within the chamber adapted to be rotated, a first sprocket mounted on the portion of the shaft, a second shaft rotatably mounted on the lower end of the case having a portion thereof located within the chamber, said second shaft being laterally spaced from and generally parallel to the first shaft, a second sprocket mounted on the portion of the second shaft in alignment with the first sprocket, endless link chain means trained about the first and second sprockets whereby rotation of the first shaft results in rotation of the second shaft, a first bevel gear mounted on the portion of the second shaft adjacent the second sprocket, said first bevel gear having a diameter larger than the diameter of the second sprocket and external bevel gear teeth tapering toward the second sprocket, a third shaft rotatably mounted on the lower end of the case for rotation about an axis generally normal to the second shaft and in the same horizontal plane as the axis of rotation of the second shaft, and a second bevel gear mounted on and secured to the third shaft located in longitudinal alignment with the second sprocket and in driving engagement with the first bevel gear whereby rotation of the first shaft causes rotation of the third shaft, and means securing said propeller to the third shaft, and foot operated drive means mounted on the frame operably connected to said propeller transmission means for rotating said propeller thereby moving said watercraft on said body of water.

2. The watercraft of claim 1 wherein: each platform has a deck and a bottom wall located below the deck, said bottom wall having a plurality of upright longitudinal ribs.

3. The watercraft of claim 2 wherein: the deck includes a top surface and a plurality of surfaces located above the plane of the top surface.

4. The watercraft of claim 1 wherein: the platform has an enclosed interior chamber.

5. The watercraft of claim 1 wherein: each platform has a side wall, a first inwardly directed ear joined to the side wall, and a second inwardly directed ear joined to the side wall, each ear having a hole to accommodate the means mounting the platform on the transverse member.

6. The watercraft of claim 5 wherein: each platform has a deck having a recessed first portion opposite the first ear, and a recessed second portion opposite the second ear, said first and second portions each having a hole to accommodate the means mounting the platform on the transverse member.

7. The watercraft of claim 1 wherein: each platform has a deck, said deck has a bottom wall, said bottom wall having transverse grooves to accommodate the transverse members.

8. The watercraft of claim 1 wherein: the foot operated drive means includes an endless link chain and sprocket drive, shield means located on opposite sides of the endless link chain, and means mounting the shield means on the frame.

9. The watercraft of claim 8 wherein: the shield means comprises a first member located on one side of the endless link chain, a second member located on the other side of the endless link chain, means connecting the first member to the second member, said means mounting the shield means on the frame comprise lateral members connected to the first and second members and attached to the frame.

10. The watercraft of claim 1 wherein: the propeller has a central hub having a pocket for accommodating a portion of the power transmission means, a plurality of blades joined to said hub and extended outwardly therefrom, each blade includes a leading edge, a convex-shaped trailing lobe adjacent the hub, a trailing edge and a convex outer end joined to the leading edge and trailing edge, a forward surface having a transverse convex shape, an aft surface, said surfaces extending between said leading edge and trailing edge and having helical curvatures and pitch angles that increase from the hub to the outer end of the blade.

11. The watercraft of claim 10 wherein: a pair of blades joined to opposite sides of the hub.

12. The watercraft of claim 10 wherein: the hub has a rearwardly converging generally cone-shaped outer surface.

13. The watercraft of claim 10 wherein: the pitch angles increase from about 20 degrees at the hub to about 70 degrees at the outer end of the blade.

14. A watercraft comprising: a pair of longitudinal float means for supporting the watercraft on a body of water, transverse members extended between and attached to the float means to retain the float means laterally relative to each other, a frame, means mounting the frame on the transverse members, means for steering the watercraft, platform means located adjacent the frame, means mounting the platform means on the transverse members, a propeller, propeller power transmission means mounted on the frame for moving said watercraft on said water, the propeller transmission means includes a generally flat and narrow case, said case having an elongated and narrow internal chamber, and an upper end and a lower end, a power input first shaft rotatably mounted on the upper end of the case, said first shaft having a portion thereof located within the chamber adapted to be rotated, a first sprocket mounted on the portion of the shaft, a second shaft rotatably mounted on the lower end of the case having a portion thereof located within the chamber, said second shaft being laterally spaced from add generally parallel to the first shaft, a second sprocket mounted on the portion of the second shaft in alignment with the first sprocket, endless link chain means trained about the first and second sprockets whereby rotation of the first shaft results in rotation of the second shaft, a first bevel gear mounted on the portion of the second shaft adjacent the second sprocket, said first bevel gear having a diameter larger than the diameter of the second sprocket and external bevel gear teeth tapering toward the second sprocket, a third shaft rotatably mounted on the lower end of the case for rotation about an axis generally normal to the second shaft and in the same horizontal plane as the axis of rotation of the second shaft, and a second bevel gear mounted on and secured to the third shaft located in longitudinal alignment with the second sprocket and in driving engagement with the first bevel gear whereby rotation of the first shaft causes rotation of the third shaft, and means securing said propeller to the third shaft, and drive means mounted on the frame operably connected to said propeller transmission means for rotating said propeller thereby moving said watercraft on said body of water.

15. The watercraft of claim 14 wherein: the platform means includes a deck and a bottom wall located below the deck, said bottom wall having a plurality of upright longitudinal ribs.

16. The watercraft of claim 15 wherein: the deck includes a top surface and a plurality of surfaces located above the plane of the top surface.

17. The watercraft of claim 14 wherein: the platform means has an enclosed interior chamber.

18. The watercraft of claim 14 wherein: the platform means has a side wall, a first inwardly directed ear joined to the side wall, and a second inwardly directed ear joined to the side wall, each ear having a hole to accommodate the means mounting the platform means on the transverse member.

19. The watercraft of claim 18 wherein: the platform means has a deck having a recessed first portion opposite the first ear, and the second end has a recessed second portion opposite the second ear, said first and second portions each having a hole to accommodate the means mounting the platform means on the transverse member.

20. The watercraft of claim 14 wherein: the platform means has a deck, said deck has a bottom wail, said bottom wail having transverse grooves to accommodate the transverse members.

21. The watercraft of claim 14 wherein: the drive means includes an endless link chain and sprocket drive, shield means located on opposite sides of the endless link chain, and means mounting the shield means on the frame.

22. The watercraft of claim 21 wherein: the shield means comprises a first member located on one side of the endless link chain, a second member located on the other side of the endless link chain, means connecting the first member to the second member, said means mounting the shield means on the frame comprise lateral members connected to the first and second members and attached to the frame.

23. The watercraft of claim 14 wherein: the propeller has a central hub having a pocket for accommodating a portion of the power transmission means, a plurality of blades joined to said hub and extended outwardly therefrom, each blade includes a leading edge, a convex-shaped trailing lobe adjacent the hub, a trailing edge and a convex outer end joined to the leading edge and trailing edge, a forward surface having a transverse convex shape, an aft surface, said surfaces extending between said leading edge and trailing edge and having helical curvatures and pitch angles that increase from the hub to the outer end of the blade.

24. A power transmission assembly comprising: a housing having a generally flat and narrow case, said case having an elongated and narrow internal chamber, and an upper end and a lower end, a power input first shaft rotatably mounted on the upper end of the case, said first shaft having a portion thereof located within the chamber adapted to be rotated, a first sprocket mounted on the potion of the shaft, a second shaft rotatably mounted on the lower end of the case having a portion thereof located within the chamber, said second shaft being laterally spaced from and generally parallel to the first shaft, a second sprocket mounted on the portion of the second shaft in alignment with the first sprocket, endless link chain means trained about the first and second sprockets whereby rotation of the first shaft results in rotation of the second shaft, a first bevel gear mounted on the portion of the second shaft in side-by-side relation with one side of the second sprocket, said first bevel gear having a diameter larger than he diameter of the second sprocket and external bevel gear teeth tapering toward the second sprocket, a third shaft rotatably mounted on the lower end of the case for rotation about an axis generally normal to the second shaft and in the same horizontal plane as the axis of rotation of the second shaft, and a second bevel gear mounted on and secured to the third shaft located in longitudinal alignment with the second sprocket and longitudinal dimension of the chain means, and in driving engagement with the first bevel gear whereby rotation of the first shaft causes rotation of the third shaft.

25. The power transmission of claim 24 wherein: the third shaft has a portion thereof extended outwardly from said housing.

26. The power transmission of claim 25 including: a propeller mounted on and secured to the portion of the third shaft whereby the propeller is rotated in response to rotation of the first shaft.

27. The power transmission of claim 26 wherein: the propeller has a central hub with a pocket accommodating the portion of the third shaft, means securing the hub to the third shaft, a plurality of blades joined to said hub and extended outwardly therefrom, each blade having a rearwardly extending convex lobe adjacent the hub, a leading edge, a trailing edge, and a convex outer end joined to the leading and trailing edges, a forward surface having a transverse convex shape, and an aft surface, said surfaces having helical curvatures and pitch angles that increase from the hub to the outer end of the blade.

28. A propeller for a watercraft comprising: a central hub having a pocket for accommodating a drive shaft, a plurality of blades joined to said hub and extended outwardly therefrom, each blade includes a broad convex curved leading edge, a convex-shaped trailing lobe adjacent the hub, said trailing lobe having a convex curvature greater than the convex curvature of the leading edge, a trailing edge and a convex outer end joined to the leading edge and trailing edge, said leading and trailing edges tapering outwardly toward each other, a forward surface having a transverse convex shape, and an aft surface, said surfaces extending between said leading edge and trailing edge and having helical curvatures and pitch angles that increase from the hub to the outer end of the blade.

29. The propeller of claim 28 wherein: a pair of blades are joined to opposite sides of the hub.

30. The propeller of claim 28 wherein: the hub has a rearwardly converging generally cone-shaped outer surface.

31. The propeller of claim 28 wherein: the hub has a plurality of ribs projected inwardly into said pocket adapted to engage the drive shaft.

32. The propeller of claim 28 wherein: the pitch angles increase from about 20 degrees at the hub to about 70 degrees at the outer end of the blade.

33. A platform for a watercraft having at least a pair of laterally spaced floatation units and cross bars connected to the floatation units comprising: a generally horizontal deck, a bottom wall located below the deck, a longitudinal outside side wall, a longitudinal inside side wall, and first and second end walls, said side walls and end walls joining the deck with the bottom wall providing an enclosed chamber between the deck and said walls, an inwardly projected first ear joined to the inside side wall adjacent the first end wall, an inwardly projected second ear joined to the inside side wall adjacent the second end wall, each ear having a first hole to accommodate means for mounting the platform on the cross bars, said deck and bottom wall having second holes transversely aligned with the first holes to accommodate means for mounting the platform on the cross bars, said bottom wall and ears having transverse grooves aligned with the first and second holes to accommodate the cross bars whereby the deck provides a foot support for a person using the watercraft.

34. The platform of claim 33 wherein: said bottom wall has a plurality of longitudinal ribs.

35. The platform of claim 33 wherein: the deck includes a top surface and a plurality of surfaces located above the horizontal plane of the top surface.

36. The platform of claim 33 wherein: the deck has first and second recessed portions, each recessed portion having the second hole to accommodate means for mounting the platform on the cross bars.

37. A watercraft comprising: a pair of longitudinal float means for supporting the watercraft on a body of water, transverse members extended between and attached to the float means to retain the float means laterally relative to each other, a frame, means mounting the frame on the transverse members, means for steering the watercraft, a propeller, propeller power transmission means mounted on the frame for moving said watercraft on said water, the propeller transmission means includes a generally flat and narrow case, said case having an elongated and narrow internal chamber, and an upper end and a lower end, a power input first shaft rotatably mounted on the upper end of the case, said first shaft having a portion thereof located within the chamber adapted to be rotated, a first sprocket mounted on the portion of the shaft, a second shaft rotatably mounted on the lower end of the case having a portion thereof located within the chamber, said second shaft being laterally spaced from and generally parallel to the first shaft, a second sprocket mounted on the portion of the second shaft in alignment with the first sprocket, endless link chain means trained about the first and second sprockets whereby rotation of the first shaft results in rotation of the second shaft, a first bevel gear mounted on the portion of the second shaft in side-by-side relation with one side of the second sprocket, said first bevel gear having a diameter larger than the diameter of the second sprocket and external bevel gear teeth tapering toward the second sprocket, a third shaft rotatably mounted on the lower end of the case for rotation about an axis generally normal to the second shaft and in the same horizontal plane as the axis of rotation of the second shaft, and a second bevel gear mounted on and secured to the third shaft located in longitudinal alignment with the second sprocket and in driving engagement with the first bevel gear whereby rotation of the first shaft causes rotation of the third shaft, and means securing said propeller to the third shaft, and drive means mounted on the frame operably connected to said propeller transmission means for rotating said propeller thereby moving said watercraft on said body of water.

38. The watercraft of claim 37 wherein: the propeller has a central hub with a pocket accommodating the portion of the third shaft, means securing the hub to the third shaft, a plurality of blades joined to said hub and extended outwardly therefrom, each blade having a rearwardly extending convex lobe adjacent the hub, a leading edge, a trailing edge, and a convex outer end joined to the leading and trailing edges, a forward surface having a transverse convex shape, and an aft surface, said surfaces having helical curvatures and pitch angles that increase from the hub to the outer end of the blade.

* * * * *